US010174923B2

(12) United States Patent
Sonneman

(10) Patent No.: US 10,174,923 B2
(45) Date of Patent: Jan. 8, 2019

(54) HANGER FOR A MODULAR LIGHTING SYSTEM HAVING A MAIN BODY WITH TWO CHANNELS TO ACCOMMODATE TWO SEGMENTS OF A POWER BAR

(71) Applicant: Contemporary Visions, LLC, Larchmont, NY (US)

(72) Inventor: Robert A. Sonneman, Mamaroneck, NY (US)

(73) Assignee: Contemporary Visions, LLC, Larchmont, NY (US)

( * ) Notice: Subject to any disclaimer, the term of this patent is extended or adjusted under 35 U.S.C. 154(b) by 0 days.

(21) Appl. No.: 15/584,171

(22) Filed: May 2, 2017

(65) Prior Publication Data

US 2018/0128470 A1 May 10, 2018

Related U.S. Application Data

(60) Provisional application No. 62/419,505, filed on Nov. 9, 2016.

(51) Int. Cl.

| | |
|---|---|
| ***H01R 13/66*** | (2006.01) |
| ***F21V 23/06*** | (2006.01) |
| ***H01R 13/62*** | (2006.01) |
| ***F21V 23/00*** | (2015.01) |
| ***H01R 25/14*** | (2006.01) |
| ***F21S 8/06*** | (2006.01) |
| ***F21V 21/108*** | (2006.01) |
| ***F21V 21/35*** | (2006.01) |

(52) U.S. Cl.

CPC ..... *F21V 23/06* (2013.01); *F21S 8/061* (2013.01); *F21S 8/063* (2013.01); *F21V 21/108* (2013.01); *F21V 21/35* (2013.01); *F21V 23/00* (2013.01); *H01R 13/62* (2013.01); *H01R 25/14* (2013.01)

(58) Field of Classification Search

CPC ..... H01R 13/60; H01R 13/62; H01R 13/66; H01R 13/73; H01R 9/26; H01R 9/2608; H01R 25/14

USPC ..... 439/529, 532, 533; 362/382, 387

See application file for complete search history.

(56) References Cited

U.S. PATENT DOCUMENTS

| | | | |
|---|---|---|---|
| 2,292,395 | A | 8/1942 | O'Brien |
| D217,785 | S | 6/1970 | Wolff |

(Continued)

FOREIGN PATENT DOCUMENTS

| | | | |
|---|---|---|---|
| CN | 200 986 123 | Y | 12/2007 |
| CN | 205261379 | U | 5/2016 |

(Continued)

OTHER PUBLICATIONS

USPTO, Non-Final Office Action dated Jan. 13, 2017 issued in corresponding U.S. Appl. No. 15/251,369.

(Continued)

*Primary Examiner* — Chandrika Prasad

(74) *Attorney, Agent, or Firm* — Gottlieb, Rackman & Reisman, P.C.

(57) ABSTRACT

A hanger for supporting one power bar from another vertically offset power bar or supporting a pendant from a power bar. The hanger has a main body forming channels receiving segments of the power bar, a cover forming an interference fit with the body to define a base and a conductive member that extends between the base and either a pendant or another power bar.

18 Claims, 21 Drawing Sheets

(56) References Cited

U.S. PATENT DOCUMENTS

D222,748 S 12/1971 Strianese
3,716,031 A 2/1973 Rowbury
3,748,463 A 7/1973 Trassinelli
4,723,747 A 2/1988 Karp
4,758,935 A 7/1988 Frassati et al.
4,763,870 A 8/1988 Wodlinger
D301,304 S 5/1989 Will
D317,058 S 5/1991 Sonneman
5,025,355 A 6/1991 Harwood
D320,465 S 10/1991 Sonneman
5,065,295 A * 11/1991 de la Haye ..... F21V 19/0085 362/391
5,105,349 A 4/1992 Falls
D360,046 S 7/1995 Sugiura
5,440,469 A 8/1995 Gomes
5,455,754 A 10/1995 Hoffner
5,584,576 A 12/1996 Wei Hong
D392,407 S 3/1998 Johnson et al.
5,833,358 A 11/1998 Patik
6,135,615 A 10/2000 Lee
6,179,442 B1 1/2001 Schurle
6,241,369 B1 6/2001 Mackiewicz
6,244,733 B1 6/2001 Fong et al.
6,341,979 B1 1/2002 Yamamoto
6,409,524 B1 6/2002 Miller et al.
6,489,748 B1 12/2002 Okamura
6,659,623 B2 12/2003 Friend
6,769,790 B2 8/2004 Fruhm
D507,374 S 7/2005 Chen
7,172,332 B2 * 2/2007 Mobarak ..... F21V 21/35 362/147
7,246,935 B2 7/2007 Benghozi et al.
7,397,384 B1 7/2008 MacKenzie, IV
7,503,778 B2 3/2009 Lehman et al.
7,507,005 B1 3/2009 Mier-Langner
7,520,762 B2 4/2009 Lehman et al.
7,520,763 B1 4/2009 Buse
7,527,406 B2 5/2009 Kwon
D595,884 S 7/2009 Liao
7,563,000 B2 * 7/2009 Gierveld ..... G09F 17/00 362/249.01
7,571,736 B1 8/2009 Chu
7,654,834 B1 2/2010 Imier-Langner et al.
D611,169 S 3/2010 Harder
D620,168 S 7/2010 Sabernig
7,794,132 B2 9/2010 Cunius
7,798,824 B2 9/2010 Fong
7,806,913 B2 10/2010 Fanger
D629,954 S 12/2010 Compton
D632,423 S 2/2011 Canfield
7,955,125 B1 6/2011 Petrillo
D648,470 S 11/2011 Rains
D649,692 S 11/2011 Trzesniowski
8,061,865 B2 11/2011 Piepgras et al.
D671,670 S 11/2012 Sonneman
8,398,276 B2 3/2013 Pearson et al.
D680,673 S 4/2013 Levine
D689,221 S 9/2013 Isaac
8,523,378 B2 9/2013 Schulzman
8,584,412 B2 11/2013 Frecska et al.
8,616,871 B2 12/2013 Galomb
8,733,710 B1 5/2014 Suazo
8,794,804 B2 8/2014 Verfuerth
8,814,383 B2 8/2014 Bizzotto et al.
8,840,319 B2 9/2014 Hogue
8,967,573 B2 3/2015 Hemmer
D739,070 S 9/2015 Wilson
9,136,659 B2 9/2015 Fishman et al.
D747,636 S 1/2016 Maher
9,387,268 B2 7/2016 Farren
D765,296 S 8/2016 Wei
9,464,772 B2 10/2016 O'Brien et al.
9,472,912 B2 10/2016 Schirmeier
D772,467 S 11/2016 Sonneman
D772,475 S 11/2016 Sonneman
D773,099 S 11/2016 Sonneman
D773,101 S 11/2016 Sonneman
D773,715 S 12/2016 Sonneman
D773,719 S 12/2016 Sonneman
D773,725 S 12/2016 Sonneman
D775,397 S 12/2016 Sonneman
D779,113 S 2/2017 Sonneman
D779,437 S 2/2017 Sonneman
D779,712 S 2/2017 Sonneman
D779,713 S 2/2017 Sonneman
D779,714 S 2/2017 Sonneman
D779,715 S 2/2017 Sonneman
D782,990 S 4/2017 Sonneman
9,739,460 B2 8/2017 Haubach
9,765,954 B2 9/2017 Zaderej et al.
2003/0031018 A1 2/2003 Bray et al.
2003/0103347 A1 6/2003 Friend
2004/0005798 A1 1/2004 Lin
2004/0160767 A1 * 8/2004 Mobarak ..... F21V 21/35 362/219
2005/0207173 A1 9/2005 Benghozi
2007/0053209 A1 3/2007 Uhler et al.
2007/0115694 A1 * 5/2007 Mobarak ..... F21V 21/35 362/648
2007/0247845 A1 * 10/2007 Bansbach ..... F21V 3/04 362/235
2008/0190043 A1 8/2008 Beckmann
2009/0051292 A1 2/2009 Noh
2010/0271834 A1 10/2010 Muessli
2010/0271847 A1 * 10/2010 Mobarak ..... F21V 21/35 362/648
2012/0257388 A1 10/2012 Bracher et al.
2014/0226315 A1 8/2014 Nicieja et al.
2015/0198311 A1 7/2015 O'Brien et al.
2015/0316238 A1 * 11/2015 Guilmette ..... H01R 25/14 362/218
2015/0338037 A1 11/2015 Wang et al.
2016/0033098 A1 2/2016 Bergman et al.
2017/0198892 A1 * 7/2017 Sonneman ..... F21V 21/35

FOREIGN PATENT DOCUMENTS

DE 8708815 U1 11/1987
DE 4414046 A1 10/1995
DE 29705852 U1 5/1997
DE 19849101 A1 4/1999
DE 202004001178 U1 5/2004
EP 0320661 A2 6/1989
EP 0379244 A1 7/1990
EP 0734108 A2 9/1996
EP 1757858 A2 2/2007
EP 1847763 A1 10/2007
EP 2821695 A1 1/2015
EP 3196547 A1 7/2017
FR 608 016 A 7/1926
FR 2588713 A1 4/1987
WO 2016/132361 A1 8/2016
WO 2016/150564 A2 9/2016

OTHER PUBLICATIONS

USPTO, Non-Office Action dated Mar. 3, 2017 issued in corresponding U.S. Appl. No. 15/255,289.
USPTO, Non-Final Office Action dated Mar. 7, 2017 issued in corresponding U.S. Appl. No. 15/287,897.
USPTO, Non-Final Office Action dated Feb. 10, 2017 issued in corresponding U.S. Appl. No. 15/286,977.
USPTO, Non-Final Office Action dated Mar. 1, 2017 issued in corresponding U.S. Appl. No. 15/378,207.
USPTO, Non-Final Office Action dated Dec. 22, 2016 issued in corresponding U.S. Appl. No. 15/197,919.
USPTO, Final Office Action dated Apr. 5, 2017 issued in corresponding U.S. Appl. No. 15/197,919.
EPO, Extended European Search Report dated Jun. 26, 2017 issued in corresponding European Patent Application No. 171506868.8.
USPTO, Final Office Action dated Jun. 6, 2017 issued in corresponding U.S. Appl. No. 15/251,369.

(56) References Cited

OTHER PUBLICATIONS

USPTO, Final Office Action dated Sep. 7, 2017 issued in corresponding U.S. Appl. No. 15/287,897.
USPTO, Non-Final Office Action dated Sep. 27, 2017 issued in corresponding U.S. Appl. No. 15/407,085.
Non-Final Office Action dated Dec. 6, 2017 issued in corresponding U.S. Appl. No. 15/446,302.
Non-Final Office Action dated Jan. 17, 2018 issued in corresponding U.S. Appl. No. 15/427,217.
Final Office Action dated Dec. 29, 2017 issued in corresponding U.S. Appl. No. 15/287,897.
Non-Final Office Action dated Jan. 12, 2018 issued in corresponding U.S. Appl. No. 15/801,855.
Non-Final Office Action dated Jan. 11, 2018 issued in corresponding U.S. Appl. No. 15/801,893.
Non-Final Office Action dated Jan. 11, 2018 issued in corresponding U.S. Appl. No. 15/808,109.
EPO, Extended European Search Report dated Jan. 3, 2018 issued in corresponding European Patent Application No. 17200563.9.
EPO, Extended European Search Report dated Jan. 5, 2018 issued in corresponding European Patent Application No. 17200550.6.
Extended European Search Report dated Mar. 27, 2018 issued in corresponding European Patent Application No. 17200553.0 filed Nov. 8, 2017.
Extended European Search Report dated Mar. 28, 2018 issued in corresponding European Patent Application No. 17200535.7 filed Nov. 8, 2017.
Extended European Search Report dated Mar. 28, 2018 issued in corresponding European Patent Application No. 17200541.5 filed Nov. 8, 2017.
Partial European Search Report dated Apr. 24, 2018 issued in corresponding European Patent Application No. 17200544.9 filed Nov. 8, 2017.
EPO, Extended European Search Report dated Aug. 7, 2018 issued in corresponding European Patent Application No. 17200544.9 filed Nov. 8, 2017.
CIPO, First Office Action dated Sep. 25, 2018 issued in corresponding Canadian Patent Application No. 2,984,651 filed Nov. 2, 2017.
CIPO, First Office Action dated Sep. 25, 2018 issued in corresponding Canadian Patent Application No. 2,984,672 filed Nov. 2, 2017.

* cited by examiner

HANGER FOR A MODULAR LIGHTING SYSTEM HAVING A MAIN BODY WITH TWO CHANNELS TO ACCOMMODATE TWO SEGMENTS OF A POWER BAR

CROSS-REFERENCE TO RELATED APPLICATION

This application claims priority under 35 U.S.C. § 120 to U.S. Provisional Patent Application No. 62/419,505, filed Nov. 9, 2016, the contents of which are incorporated herein by reference in its entirety.

FIELD OF THE INVENTION

This invention pertains generally to a modular lighting system and more specifically to a modular lighting system that includes power bars, hangers, connectors and pendants where the connectors, which includes a two-piece low profile body and at least one rod or cord that extends from the body, interconnect two power bars or a pendant to a power bar.

BACKGROUND OF THE INVENTION

Designing a lighting system for a space has always been a challenge because the lighting system has to meet utilitarian, technical and aesthetic needs. Thus, any such endeavor is successful only if technical, architectural and artistic skills are combined.

Several different types of ceiling lights are presently available, including surface mounted lights, recessed lights and hanging lights. The present invention pertains to hanging lights.

SUMMARY OF THE INVENTION

In general, the present invention is directed to a modular lighting system configured to provide light in a space. The modular lighting system can include canopies that are connectable to a power source, a plurality of power bars, a plurality of hangers, including a first set of hangers that support the power bars from the canopy and a second set of hangers that support a plurality of pendants. The hangers and power bars cooperate to provide electric power to the pendants from the canopy.

More specifically, the present disclosure is directed to a hanger that is configured to support a power bar of a modular lighting system. The power bar includes two segments that are each configured to deliver power to pendants. The hanger comprises a main body including a bottom wall, or base, a first sidewall, or projection, extending from the bottom wall in a first direction, a second first sidewall, or projection, that is spaced from the first sidewall, extending from the bottom wall in the first direction and a projection, extending from the bottom wall in the first direction, between the first sidewall and the second sidewall. The first sidewall, the second sidewall and the projection together define two channels. Each of the channels are configured to receive one of the segments of the power bar. Clips extend from the bottom wall into each of the channels and are adaptable to form an interference fit with the segments of the power bar and a conductive element is attached to and extends away from the main body. The main body can have a generally W-shaped cross-section.

Preferably, in an embodiment, the segments of the power bar face each other and are made of a non-conductive material and conductive channels are provided on the inner surface of each power bar segment. In an embodiment, the conductive element can be a cord, conductive rods or cables that are in electrical contact with the channels of the segments of the power bar through the respective bases.

The hanger can further comprise another base configured to engage a second power bar, and the conductive element can include a first end connected to the housing and a second end that is attached to the another bottom wall.

In an embodiment, the present disclosure can be directed to hanger, which is part of a modular lighting system that includes a power bar that is comprised of longitudinal segments, including a first segment and a second segment and a pendant, which is supported by the power bar and to which the power bar delivers power where the hanger comprises a housing that includes a main body and a cover. The main body has a bottom wall, or base, a projection extending from the bottom wall, a first groove and a second groove that is separated from the first groove by the projection with each of the grooves configured to receive the first segment and the second segment of the power bar, a first clip disposed in the first groove and a second clip disposed in the second groove that are each adaptable to be electrically connected and form an interference fit with the segments. The cover is positionable above the main body of the hanger, can be configured to form an interference fit with the main body and can extend over the first groove and the second groove and secure the first segment and the second segment of the power bar within the first and second grooves.

A conductive member, which can be formed of a cord or a pair of rods that are spaced apart from each other, can extend from the main body and connect the hanger to a pendant or another power bar.

The main body can include a first sidewall extending from the bottom wall in a first direction, a second sidewall that is spaced from the first side wall, extending from the bottom wall in the first direction with the projection, which is referred to as a central projection, extending from the bottom wall in the first direction, between the first sidewall and the second sidewall.

The first sidewall can include a first groove extending inwardly from an outer surface thereof the second sidewall includes a second groove extending inwardly from an outer surface thereof.

The cover can include a center portion, a first leg extending from a first side of the center portion and a second leg extending from a second side of the center portion. The first leg can include a first rib extending from a distal end of the first leg toward the second leg and the second leg can include a second rib extending from a distal end of the second leg toward the first leg.

In an embodiment, the bottom wall of the main body can include a first groove extending into the first side of thereof, a second groove that is spaced from the first groove by the first sidewall extending into the first side of thereof, a third groove extending into the second side of thereof and a fourth groove extending into the second side of thereof.

In an embodiment, the cover can include a center portion, or base, a first leg extending from a first side of center portion, a second leg, spaced from the first leg extending from the first side of the center portion, a third leg extending from a second side of the center portion and a fourth leg, spaced from the third leg extending from the second side of the center portion. The first leg can include a first rib extending from a distal end thereof toward one of the third leg and the fourth leg, the second leg includes a second rib extending from a distal end thereof toward one of the third leg and the fourth leg, the third leg includes a third rib extending from a distal end thereof toward one of the first leg and the second leg and the fourth leg includes a fourth rib extending from a distal end thereof toward one of the first leg and the second leg. The second leg can include a second rib extending from a distal end of the second leg toward the first leg.

In an embodiment, the power bars are straight or linear. In another embodiment, the power bars are circular or have some other curvilinear shape.

The power bars can extend horizontally with different power bars disposed at different heights and supported from one or more canopies or directly from a ceiling by hangers of various configurations or cables.

Preferably, at least one of the canopies is connected to a line voltage and a transformer is used to step down the line voltage to a lower voltage such as 24 VAC, which is then distributed to the pendants through the hangers and power bars.

The pendants include light emitting elements such as light emitting diodes (LEDs), and electronic circuitry that drive the LEDs. The LEDs are preferably shaped for heat dissipation. Since the LEDs have a long life, they are not replaceable, but instead the whole pendant is replaced as needed.

These various elements are combined in many different ways resulting in a virtually infinite number of configurations. One configuration may include several power bars disposed in a vertical plane. In another configuration, several power bars extend at different angles in one plane and are joined at a common point. Another configuration may include a combination of the previously mentioned configurations. Yet another configuration may include several power bars disposed at different heights or tiers with some of the power bars being perpendicular to other power bars.

DETAILED DESCRIPTION OF THE INVENTION

With reference now to the drawings, and in particular FIGS. 1-6F, embodiments of elements of modular lighting systems of the present invention will be described.

In general, each modular lighting system of the present disclosure includes one or more canopies, a plurality of hangers, a plurality of power bars and a plurality of pendants. The hangers can include (1) parallel hangers and/or (2) perpendicular hangers. Parallel hangers are used to support one power bar beneath another in parallel. Perpendicular hangers are used to support one power bar from another that extend perpendicular to each other. Hangers can support power bars from canopies, power bars from ceilings without a power connection and pendants. As will be described in detail below, each hanger must be able to interface with a power bar at at least one end. In addition, some systems may include connectors.

Unless otherwise noted, all of the hangers and all of the power bars described herein and illustrated in the figures include two interconnected elements.

Figure 1:
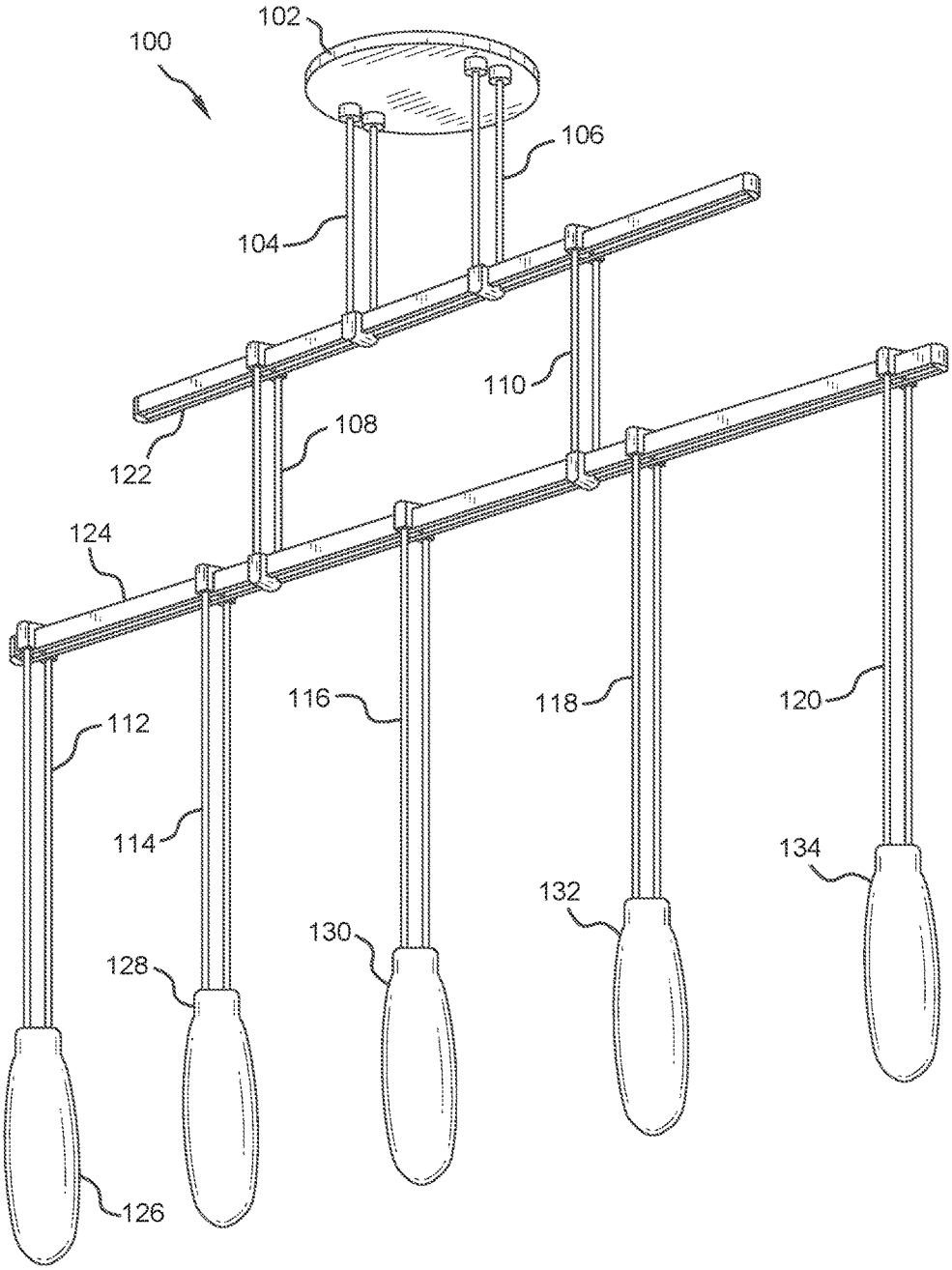
FIG. 1 is a perspective view of an embodiment of a modular lighting system.

FIG. 1 shows an embodiment of a modular lighting system 100 that includes a canopy 102 that supports the modular lighting system 100 from a ceiling or other similar architectural member in a conventional manner. In this case, the canopy 102 also provides power to the modular lighting system 100. Other, lighting systems may have several canopies that support such systems and only some or only one canopy may provide power. Here, the canopy 102 includes a conventional power supply connected to standard AC lines that provide power to the LED tubes in pendants 126, 128, 130, 132, 134 as discussed below. The power supply is hidden.

Two power feed hangers 104, 106 extend downwardly from the canopy 102. In an embodiment, each power feed hanger discussed hereinafter includes two solid bars or rods. In another embodiment (not shown), the power feed hangers are replaced by multi-strand twisted steel cables.

In FIG. 1, the hangers 104, 106 are used to support a power bar 122 and two hangers 108, 110 are interconnected with the power bar 122 and used to support a second power bar 124.

Pendant hangers 112, 114, 116, 118, 120 are used to support the plurality of pendants 126, 128, 130, 132, 134, respectively. The pendants 126, 128, 130, 132, 134 preferably include LED bulbs that run on 24 VAC.

Preferably, one of the power feed hangers 106, which includes two hanger segments, is connected to a transformer disposed within the canopy 102. In an embodiment, power from the power feed hanger 106 flows through the first power bar 122, the hanger 110, the second power bar 124 and the hangers 112, 114, 116, 118, 120 to the pendants 126, 128, 130, 132, 134, respectively. The transformer steps down the line voltage from a standard power line to 24 VAC for the pendants 126, 128, 130, 132, 134. The other power feed hanger 104 may be electrically floating. Thus, in this embodiment, all of the power bars 122, 124 carry power. However, only some of the hangers carry power.

Figure 2:
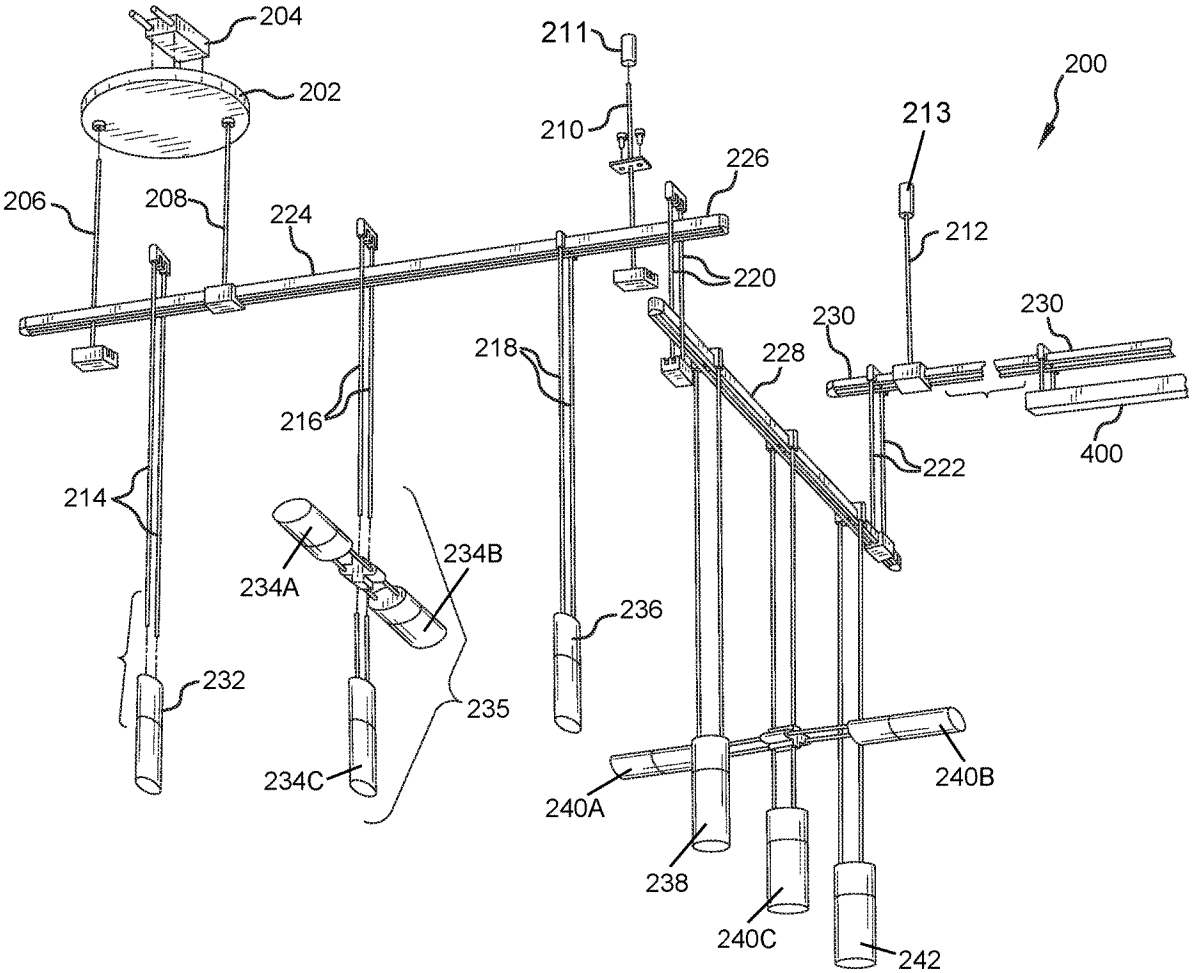
FIG. 2 is a perspective view an embodiment of another modular lighting system.

FIG. 2 shows an embodiment of another modular lighting system 200. This modular lighting system 200 includes a canopy 202 with a transformer 204. Two hangers 206, 208 extend from the canopy 202 and a first power bar 224 that is secured to the hangers 206, 208. As opposed to the hangers 104, 106, 108, 110, 112, 114, 116, 118, 120 of FIG. 1 that include two vertically extending elements, the hangers 206, 208 in FIG. 2 have a single vertically extending element, such as a rod. Each of the hangers 206, 208 provides power to one of the elements of the first power bar 224. However, because the first power bar 224 is not centered below the canopy 202, but rather extends in one direction away from the canopy 202, another hanger 210, which may be referred to as a ceiling hanger, is used to support a distal end 226 of the first power bar 224. The top end of the ceiling hanger 210 is attached to a sleeve 211 that is secured to the ceiling in a conventional manner.

Hangers 214, 216, 218 are used to attach respective pendants 232, 234A, 234B, 234C, 236 from the first power bar 224 with one of the hangers 216 used to support a cluster of pendants 235.

The modular lighting system 200 includes second power bar 228 that is supported at one end by a hanger 220 that extends near the distal end of the first power bar 224. The hanger 220 also provides power to the second power bar 228. A third power bar 230 is supported from the ceiling by ceiling hangers 212 attached to sleeves 213 (only one ceiling hanger and one sleeve is shown in FIG. 2 for clarity). The third power bar 230 supports the other end of the second power bar 228 and provides the second power bar 228 with power a through hanger 222 to a plurality of pendants 238, 240A, 240B, 240C, 242. Each of the power bars 224, 228, 230 can be used to hang pendants of various sizes and shapes and arranged in different configurations as desired. For example, as shown in FIG. 2, a linear light bar 400 can be attached to the power bar 230. Details of the light bar 400 are shown in FIGS. 5A-5G and discussed in more detail below. In FIG. 2, the light bar 400 is disposed below the third power bar 230 and is configured to direct light downward. Alternatively, the light bar 400 can be disposed above the third power bar 230 and configured to direct light upward.

Figure 3A:
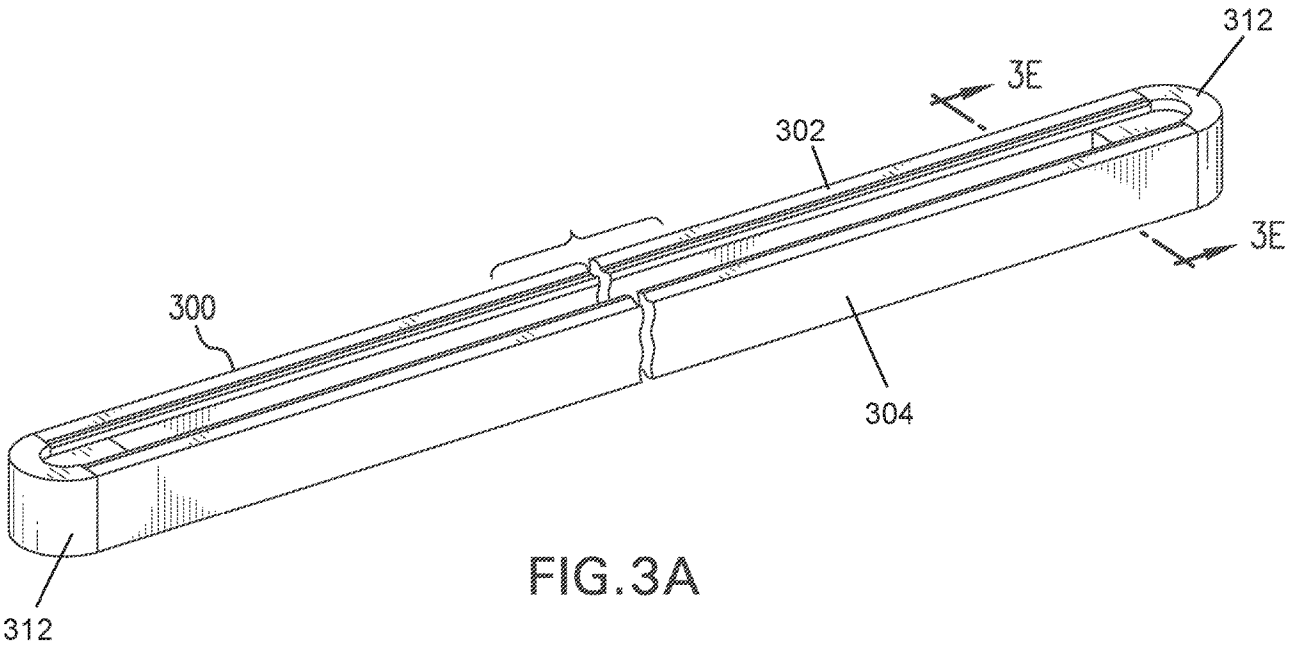
FIGS. 3A-3K are various views showing features of a power bar that can be used in the modular lighting system of FIG. 1 or FIG. 2.
Figure 3B:
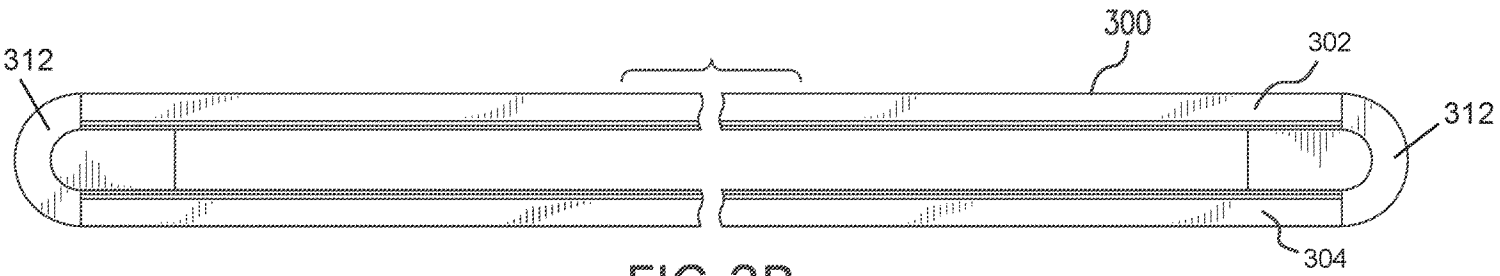
Figure 3C:
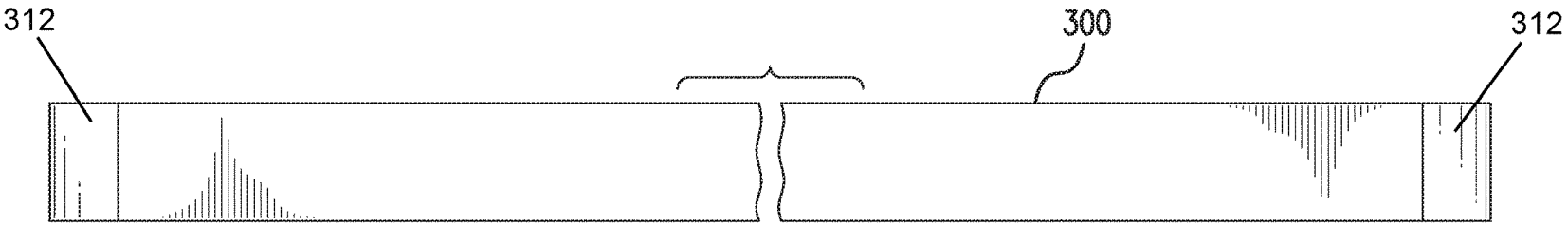
Figure 3E:
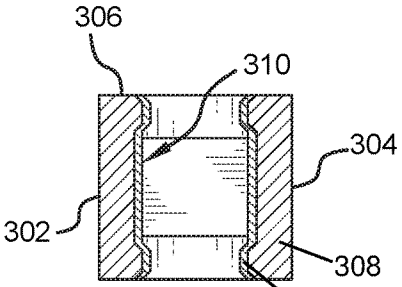
Figure 3D:
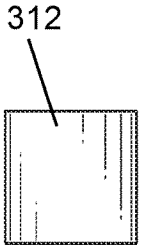
Figure 3F:
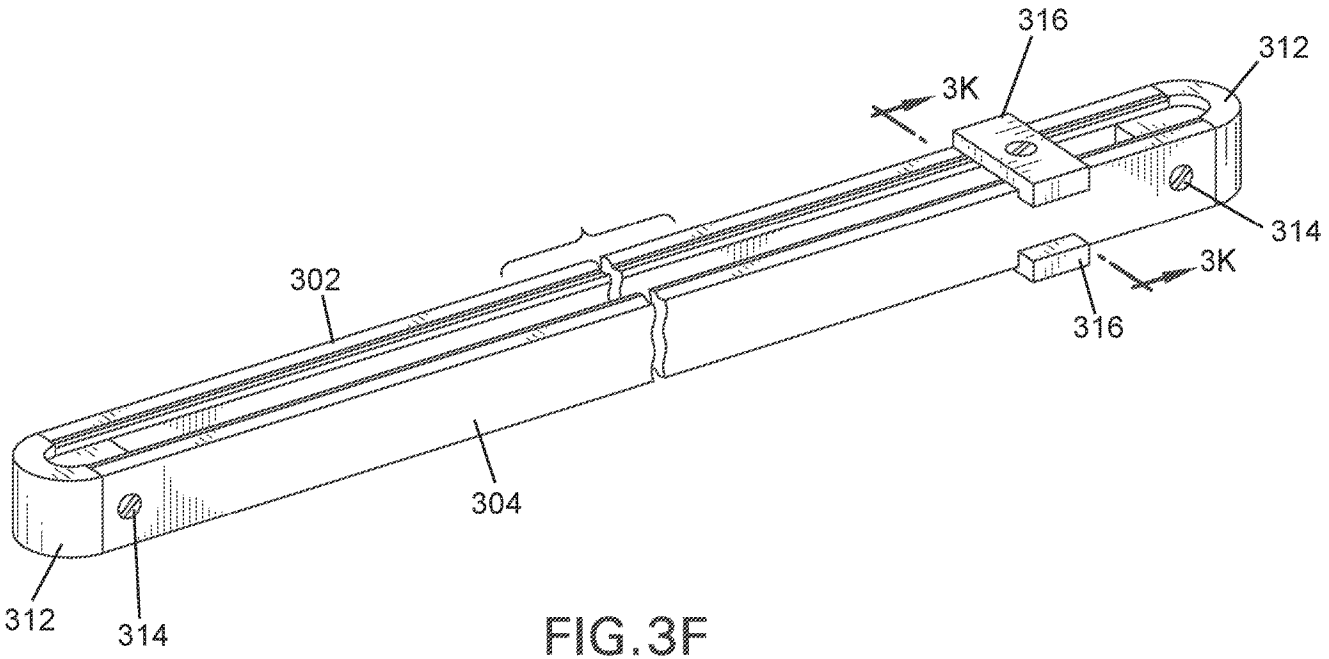
Figure 3G:
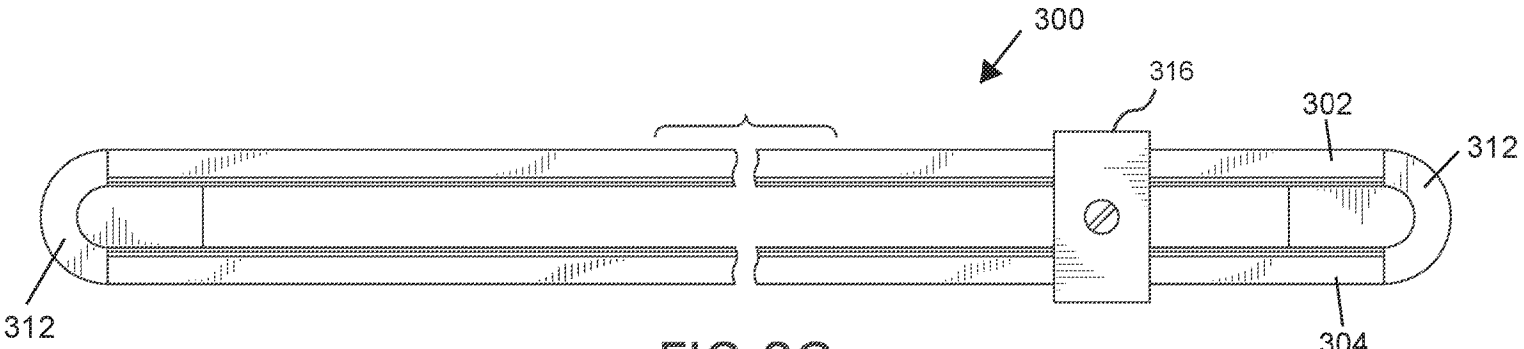

FIGS. 3A-3K show details of an embodiment of a power bar 300. Unless otherwise noted, all of the power bars discussed previously and subsequently have the same configuration. The power bar 300 is merely a representative power bar of those described herein. In FIGS. 3A-3K, the power bar 300 is shown as being straight. However, the power bar 300 can be circular, ellipsoid or another geometric shape. The power bar 300 includes two identical longitudinal segments, or rails, 302, 304 that include inner surfaces that face each other. A cross-sectional view of the power bar 300 is shown in FIG. 3E. Each rail 302, 304 includes a C-shaped main body 306, 308, respectively, made of a non-conductive material, such as a plastic material that is light weight but strong so that it can support various pendants, other power bars, etc. and channels 310 that are made of a light weight conductive material such as aluminum and are fixed to or embedded into the inside surface of each rail 302, 304. Preferably, each rail 302, 304 includes a rectangular channel. The rails 302, 304 are joined together at each end by an end connector 312. The connectors 312 are attached to the rails 302, 304 by conventional means, such as screws 314, an adhesive or other means.

Figure 3H:
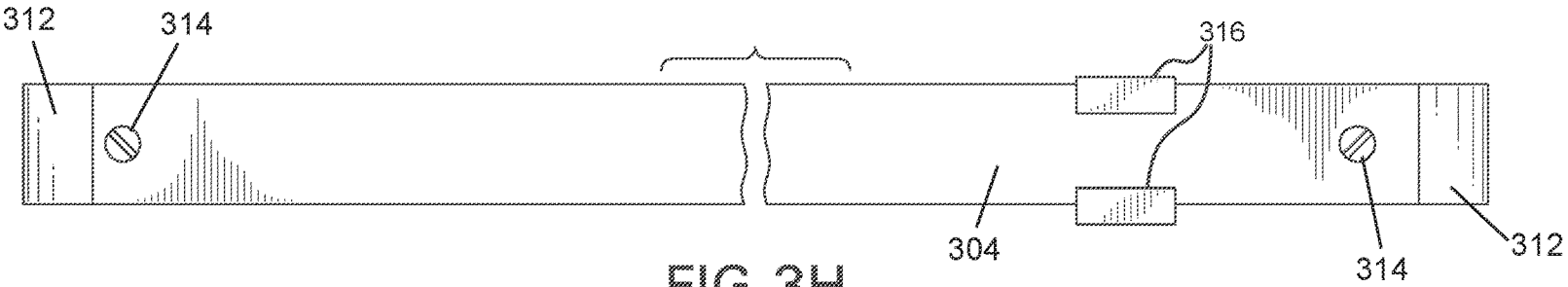
Figure 3K:
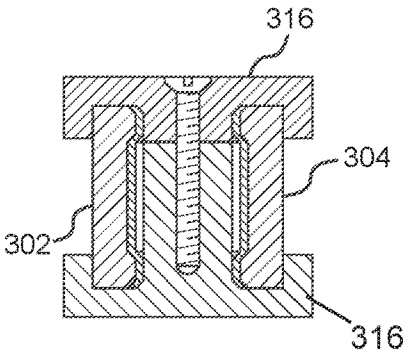
Figure 3J:
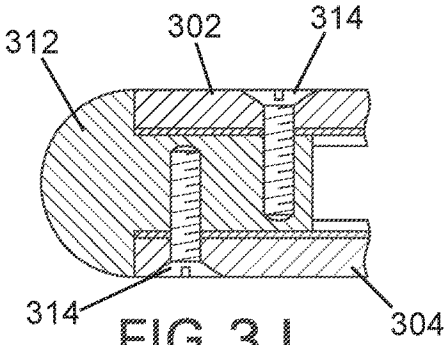
Figure 3I:
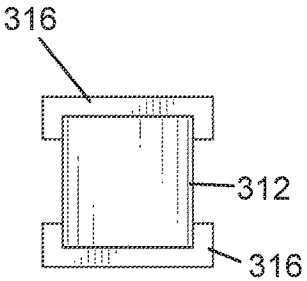

Preferably, the segments 302, 304 each have inner surfaces that are spaced at a nominal distance throughout the length of the power bar 300. The power bar 300 is made in standard lengths ranging from 12 to 48 inches. As shown in FIGS. 3H and 3K, for very long power bars, for example power bars exceeding twenty-four inches, a spacer 316 is placed between the segments 302, 304. The spacer 316 may be held in place by screws or other means.

FIGS. 4A-4I show details of a parallel bar hanger 110 from FIG. 1. The hanger 110 extends over the first power bar 122 and is used to support the second power bar 124 by extending under the second power bar 124. The hanger 110 includes two vertical segments 111A, 111B. Both the top and the bottom ends of the segments 111A, 111B are imbedded in identical W-shaped housings 113, which are shown in more detail in FIGS. 4B-4I.

The housing 113 forms two channels 115, 117 with a wall 113C separating the two channels 115, 117. Two metallic springs or clips 119, 121 extend outwardly from the housing 113 into the channels 115, 117. One of the clips 119 is electrically attached to the first segment 111A within the housing 113, and the other clip 121 is connected to the second segment 111B. Preferably, the housing 113 is made of a non-conductive material and is overmolded to cover portions of the clips 119, 121 and the segments 111A, 111B. In one embodiment, both of the housings 113, between which the segments 111A, 111B extend, have a single, unitary structure. In another embodiment, at least one of the housings 113 is made of two sections 113A, 113B that snap together forming an interference fit therebetween.

Figure 4A:
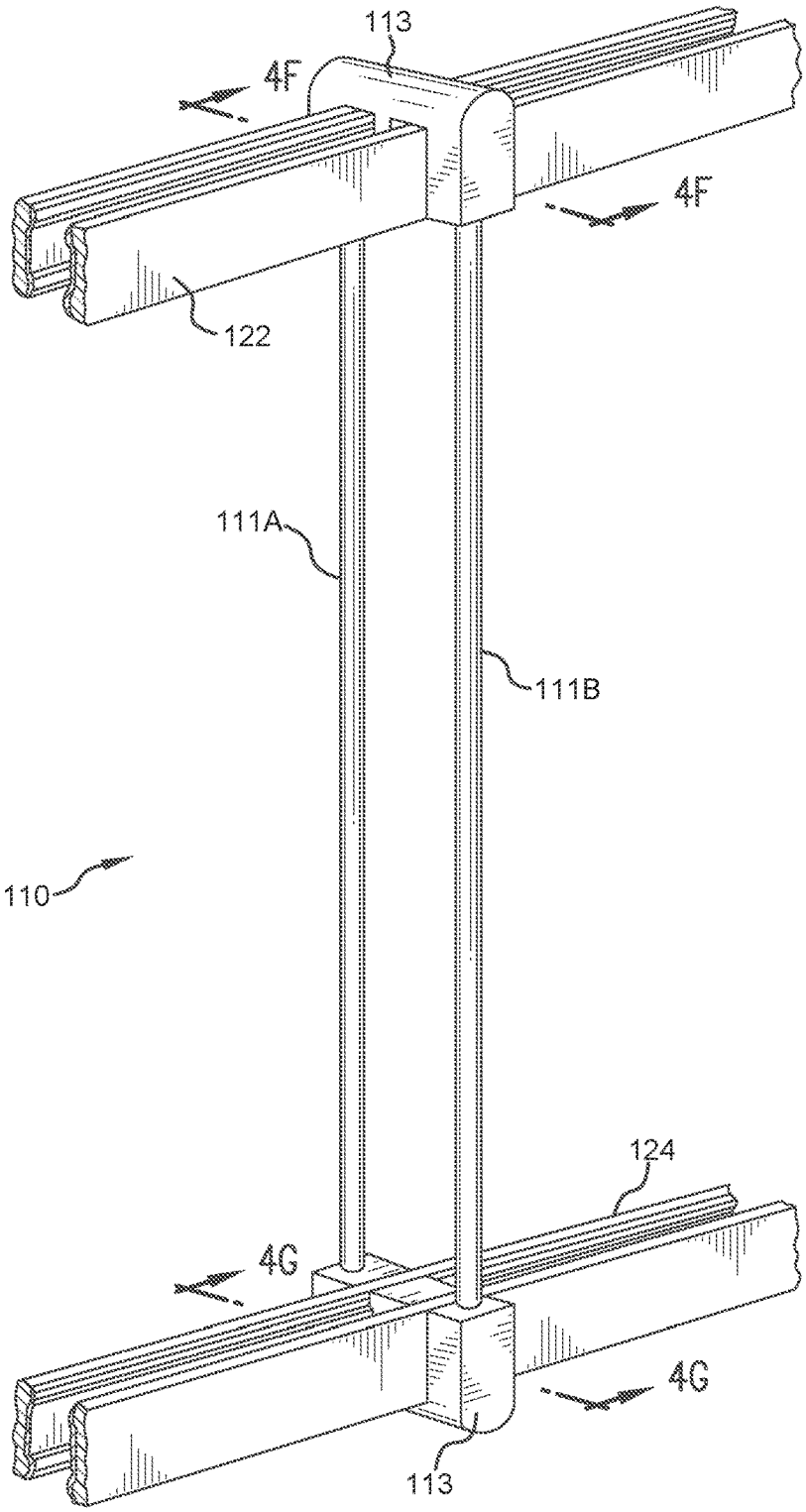
FIGS. 4A-4J are various views showing features of hangers used in the modular lighting system of FIG. 1 or FIG. 2.
Figure 4C:
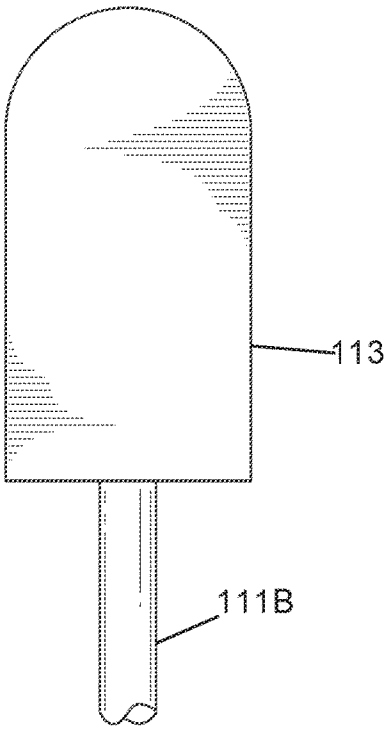
Figure 4B:
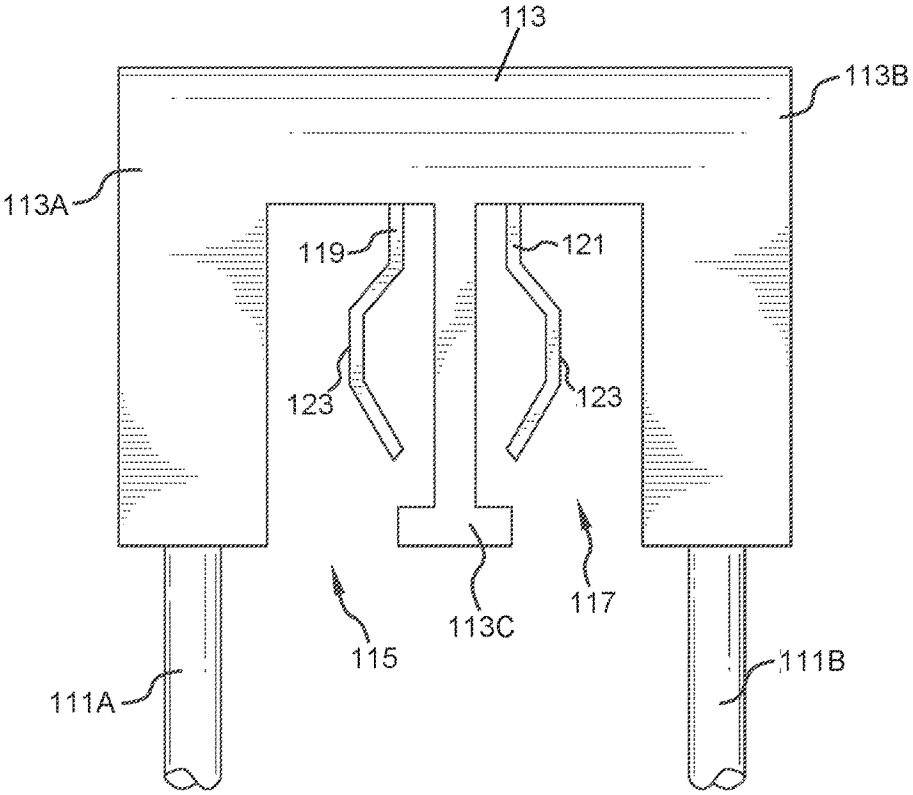
Figure 4D:
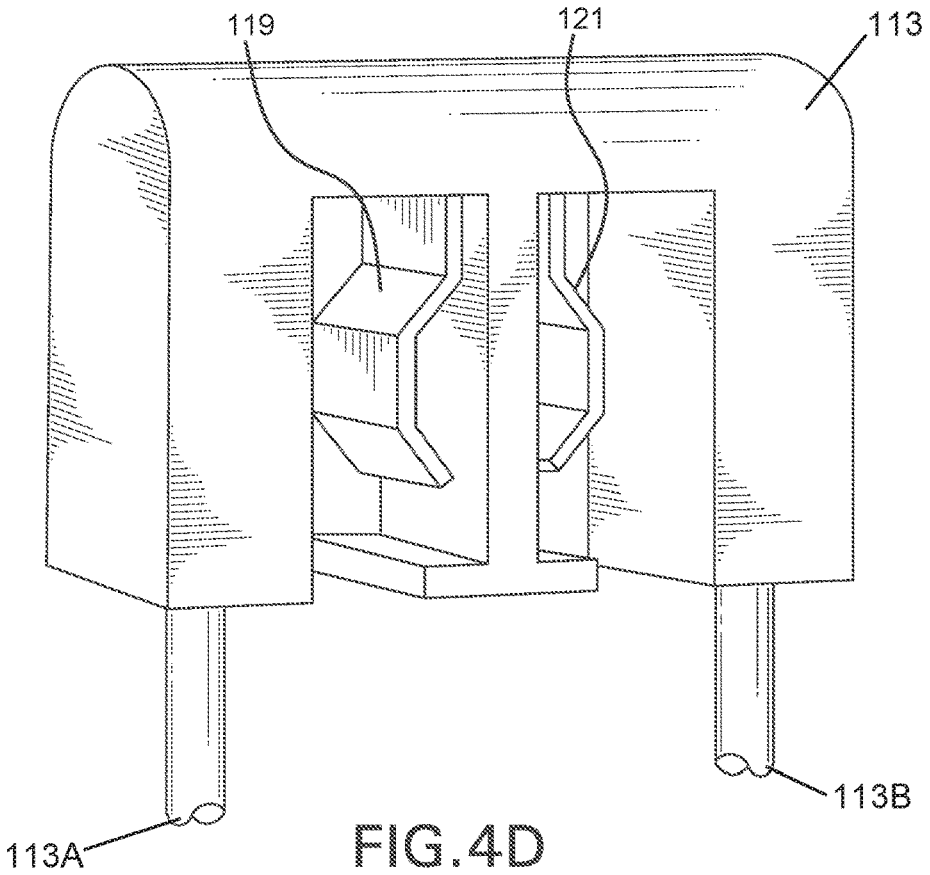
Figure 4E:
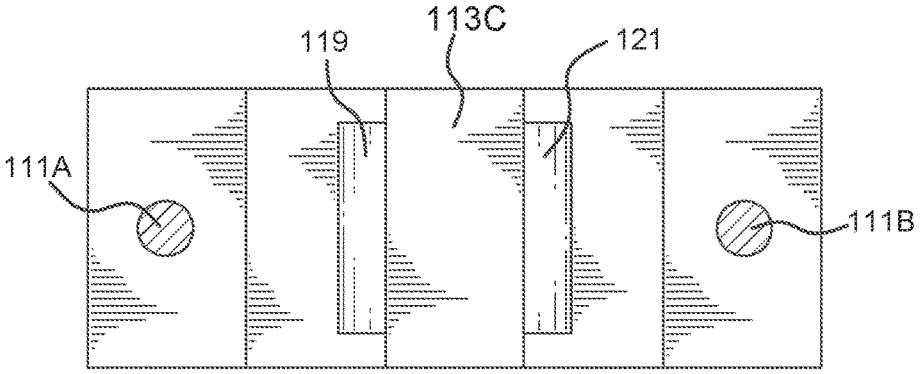
Figure 4F:
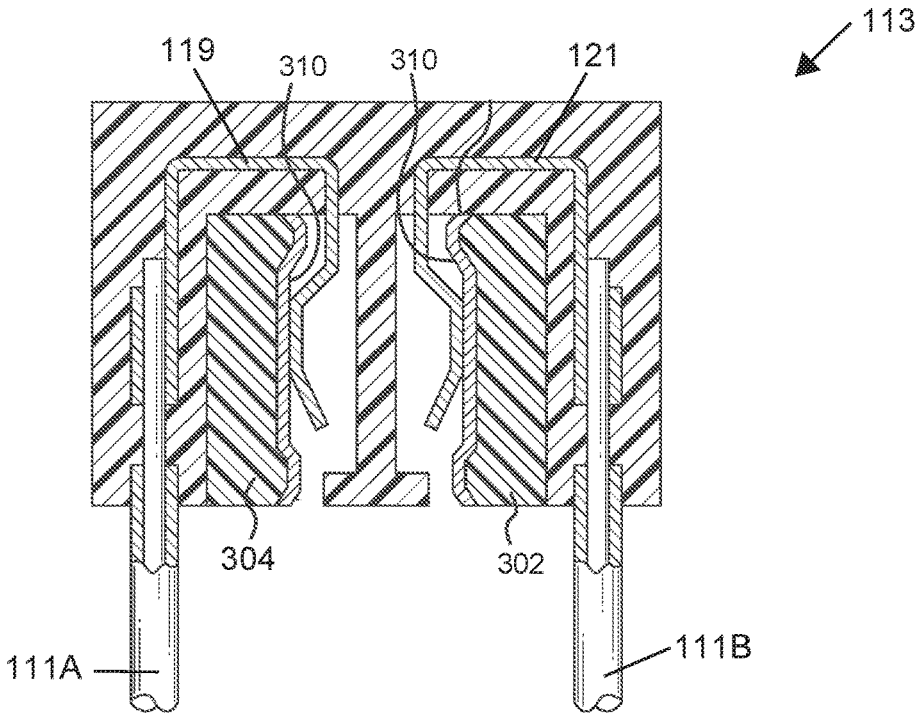
Figure 4G:
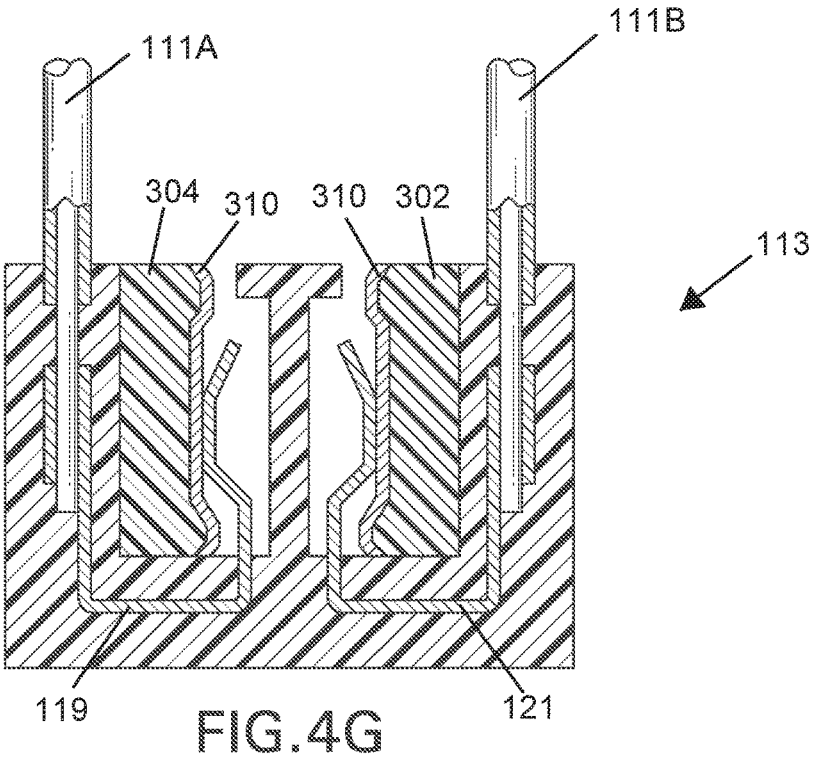

As can be seen in FIGS. 4F and 4G, the housing 113 is sized and shaped so that it can, for example, fit over and engage a power bar. Here, for illustration purposes, the housing 113 is engaged with the generic power bar 300 of FIGS. 3A-3K and elements thereof. Importantly, the clips 119, 121 are sized and shaped so that they engage the rails 302, 304. The clips 119, 121 have flat sections 123 sized and shaped to snap into the rails 302, 304 of the power bar. In this manner, not only do the clips 119, 121 provide a solid electrical contact between flat sections 123 (see FIG. 4B) and the rails 302, 304, but they also stabilize the hangers on and ensure that the powers bars are connected between the hangers and remain stiff and do move around in use. The clips 119, 121 may be made from beryllium copper.

The clips 119, 121 need not be connected electrically to the hanger segments. For example, in the configuration shown in FIG. 2, the hangers 220 provide electrical connection to the power bars 228 and 230.

The hanger segments 111A, 111B are provided in various lengths as required to obtain the various systems described above, and they are preferably in the shape of rods made of a stiff, but somewhat springy material having shape memory alloys such as a phosphor/bronze alloy. Preferably, except where an electrical contact is required, the rods are covered or painted with a thin electrically insulating material.

In an embodiment, a power bar can be connected to a housing by separating the two segments 111A, 111B, passing a first power bar and a second power bar between the segments, then lowering or raising the power bars toward the respective housings 113 and then snapping the housings 113 onto the power bars into the configurations shown in FIGS. 4F and 4G.

Figure 4H:
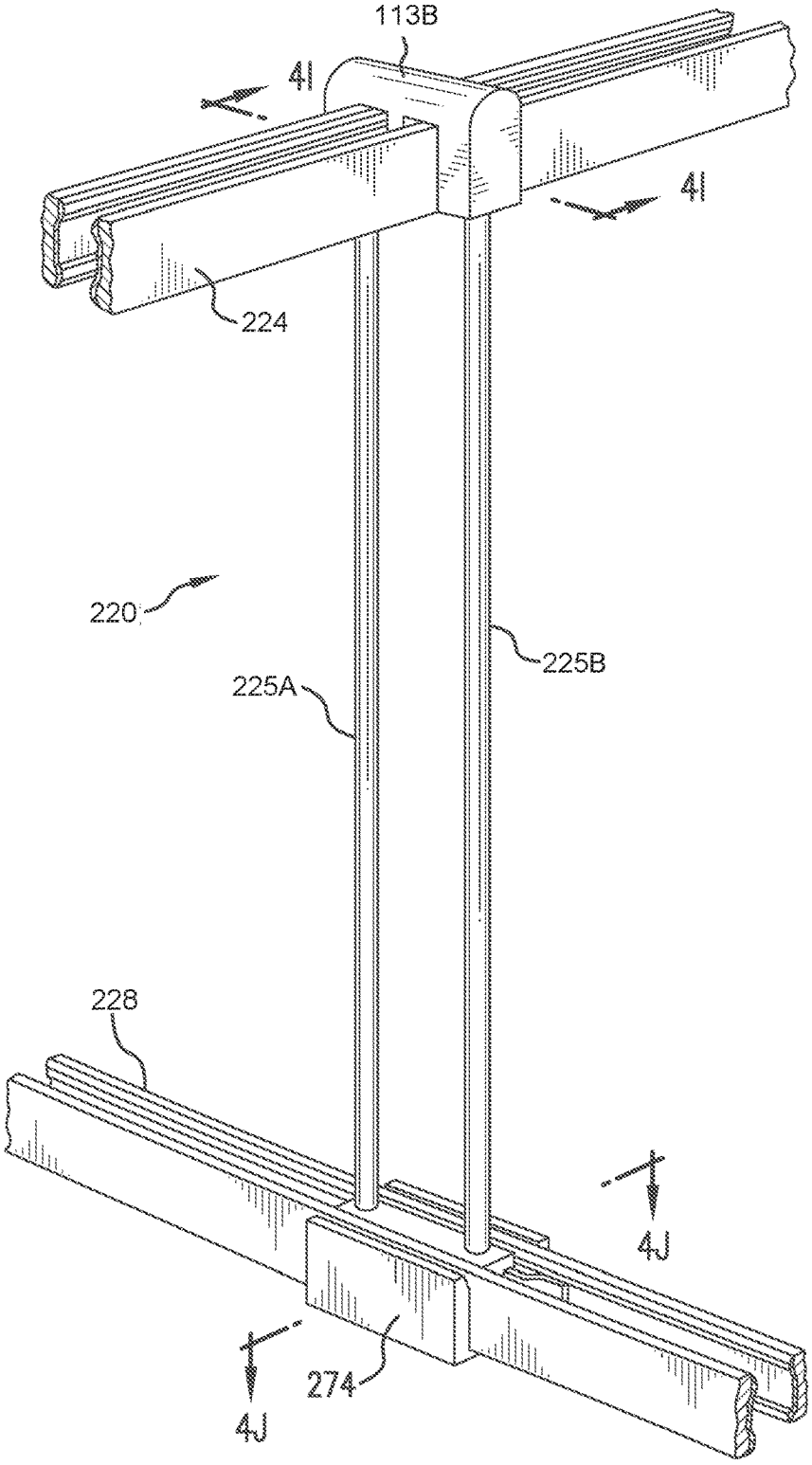
Figure 4I:
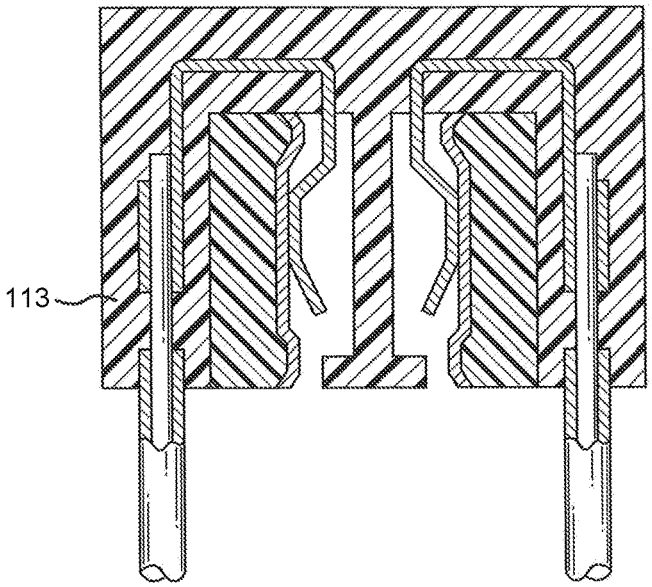

As discussed above, and illustrated in more detail below, in some instances, the power bars extend perpendicularly to each other. For example, in FIG. 2, the first power bar 224 and the second power bar 228 are perpendicular to each other. These power bars 224, 228 are interconnected using a hanger 220 that is shown in FIG. 4H. The hanger 220 has two hanger segments 225A, 225B and a housing 113B at the top similar to the housing 113 in FIGS. 4A-4G. However, at the bottom, the hanger 224 has a different base 274.

Figure 4J:
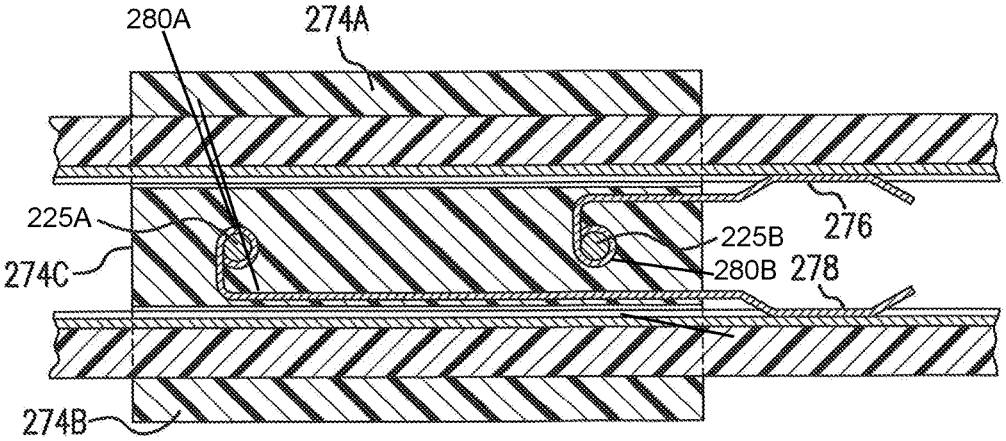

As shown in FIG. 4J, the housing 274 is formed with two side wings 274A, 274B and a center wall 274C. Clips 276, 278 are provided on the center wall 274C and are connected electrically with segments 225A, 225B, respectively. The center wall 274C is made with two holes 280A, 280B with the lower ends of the hanger segments 225A, 225B extending into the holes 280A, 280B and being secured to the housing 274. The housing 274 is sized and shaped to engage and support the power bar 228 with the hanger segments 225A, 225B providing power to the power bar 228. The housing 113 supports the first power bar 224 and provides the similar structure as discussed above and shown in FIGS. 4B-4I.

Figure 5B:
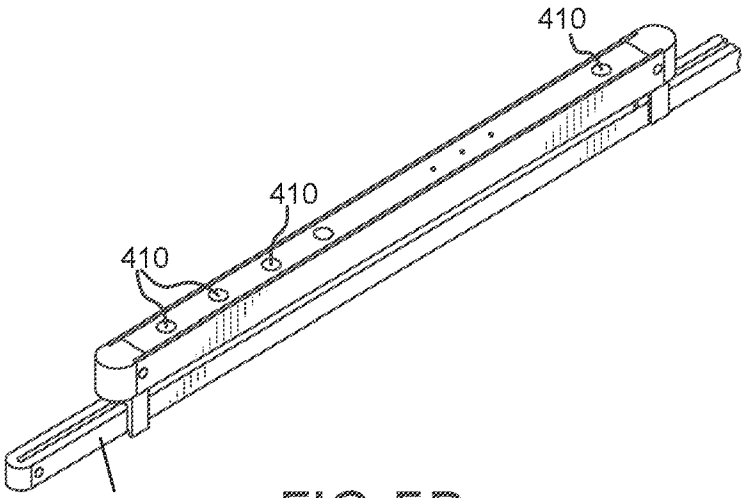
FIGS. 5A-5G show details of a light bar that can be used in a modular lighting system as shown in FIG. 2 and how the light bar can be dismounted from a respective power bar.
Figure 5A:
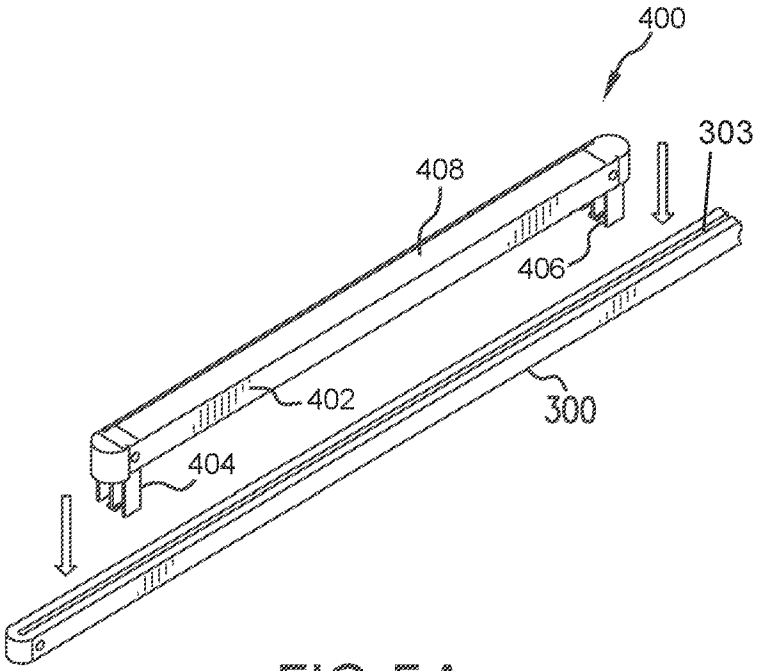
Figure 5C:
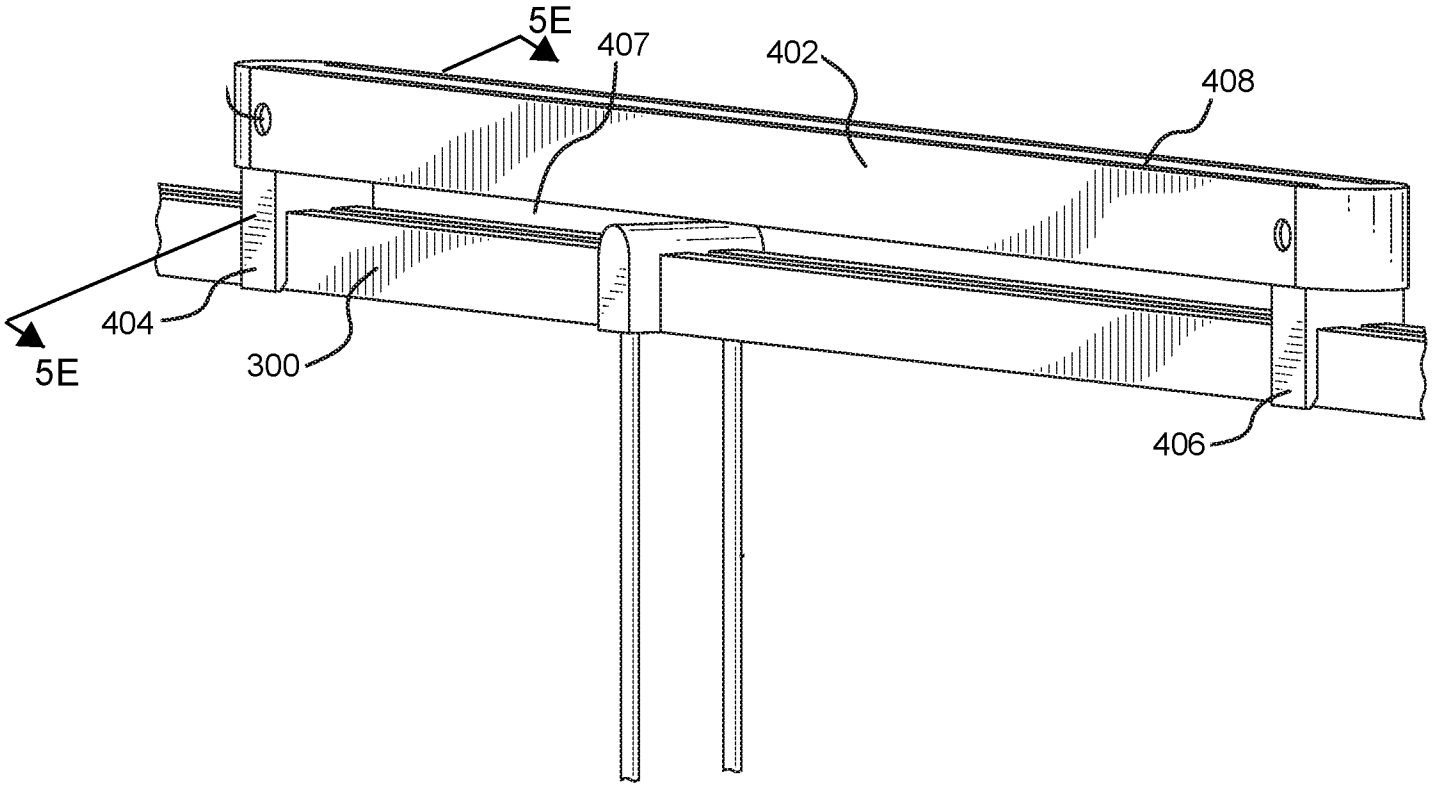
Figure 5D:
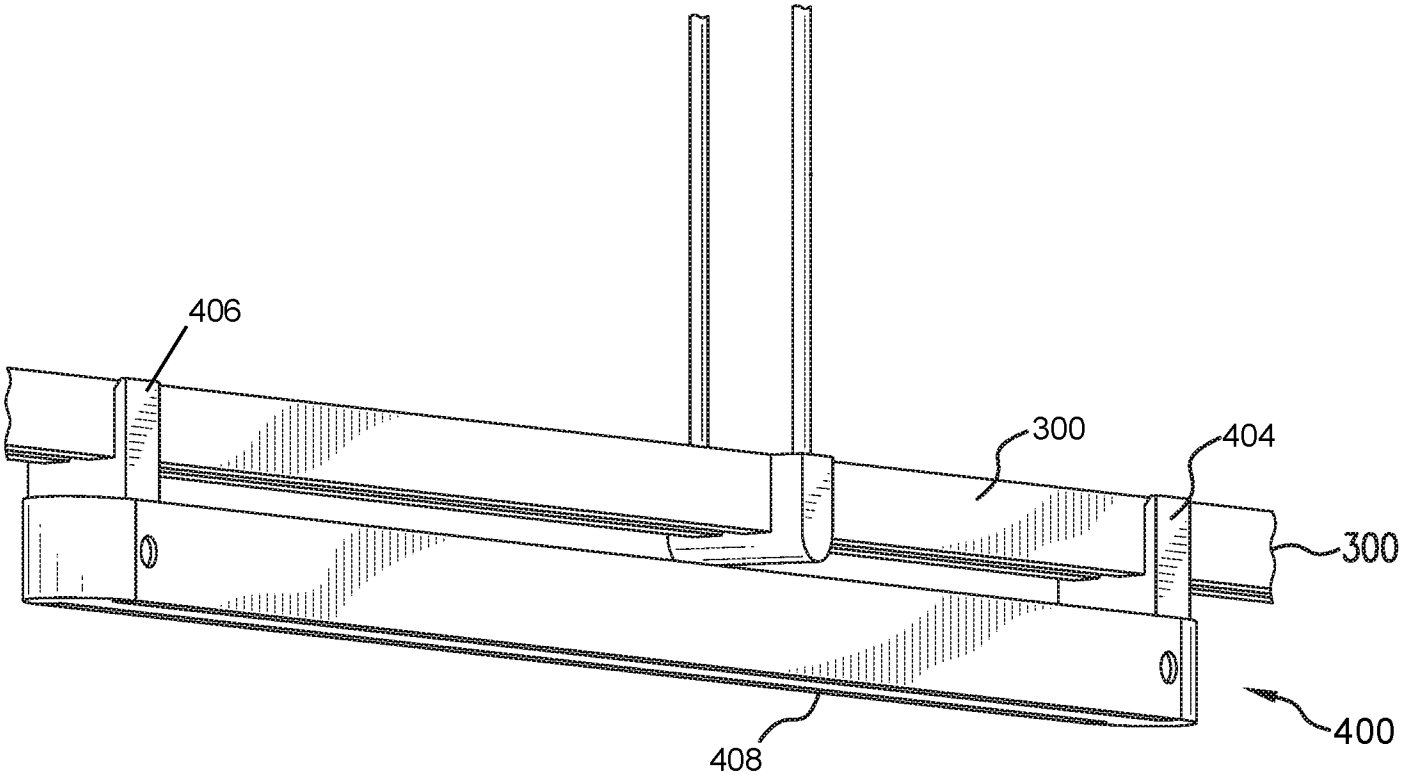

FIGS. 5A-5G show details of the light bar 400. The light bar 400 includes a substantially horizontal body 402 that is approximately the same width as the power bar 300 and includes two end connectors 404, 406. The connectors 404, 406 may have a similar structure to the housing 113 shown in FIGS. 4F-4G with the clips 119, 121 configured to securely attach the light bar 400 to the power bar 300. A top surface 408 of the light bar 400 is made of a transparent or translucent material to allow light from a plurality of LEDs 410 disposed within the body 402 to emit therefrom. In the embodiment of FIGS. 5A-5C, the light bar 400 is configured to be projected upwardly. Alternatively, the light bar 400 can be turned upside down so that the LEDS 410 are pointed downwardly and the light bar 400 can be connected to the power bar 300 by pushing upward as shown in FIG. 5D. The light bar 400 can be any desired length, such as 12", 24", 36", etc.

The light bar 400 is sized and shaped so that once it is mounted on the power bar 300, a sufficient gap 407 is formed therebetween for a hanger to be arranged between the power bar 300 and the light bar 400 as shown in FIG. 5C.

Figure 5E:
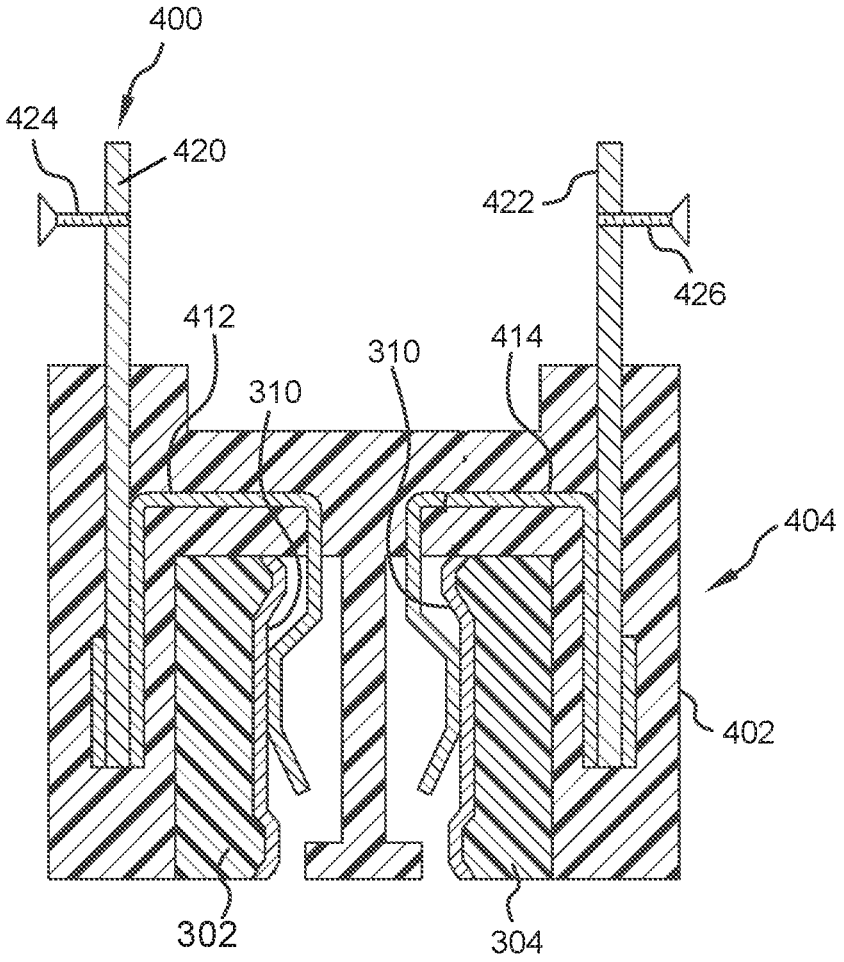

Referring now to FIG. 5E, shows a cross-sectional view of the connector 404 that has a similar structure to the connector housing 113 shown in FIG. 4G. Clips 412, 414 have the same shape and function as the clips 119, 121 in FIG. 4G. However, in FIG. 5E clips 412, 414 are mechanically and electrically connected to respective blades 420, 422 that rise straight up and are provided at their upper ends with screws 424, 426. When the light bar 400 is assembled, the blades 420, 422 slip into the body of the light bar 400 (through suitable holes, not shown) and are attached thereto by the screws 424, 426. The blades 420, 422 are connected by other members (or via screws 424, 426) electrically to a circuit board and provide power to the LEDs 410.

Figure 5G:
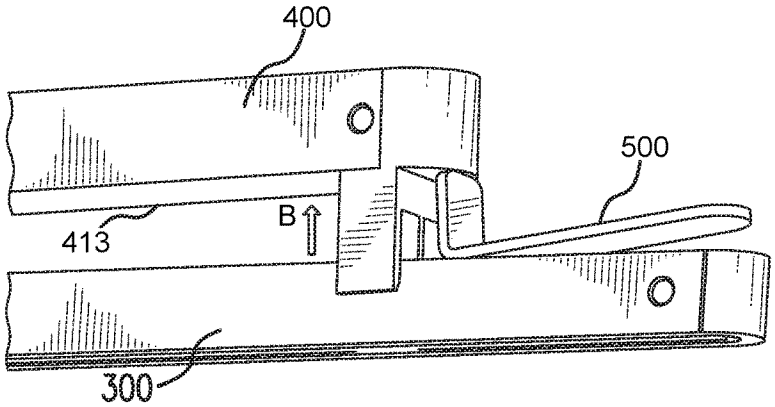
Figure 5F:
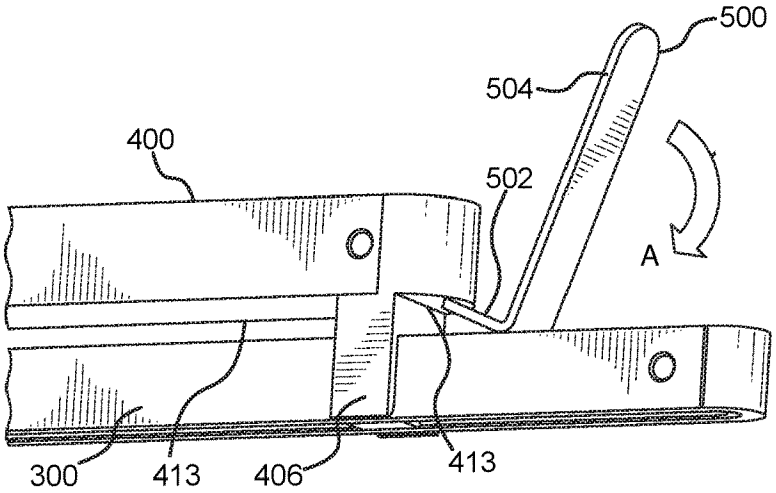

The connector 406, which is shown in FIG. 5F, has a similar structure to the connector 404, but does not provide electrical power and is used to engage the inner rails of the power bar 300 and support the light bar 400 on the power bar 300. The light bar 400 is installed in the configuration of either FIG. 5C or FIG. 5D by pressing the body 402 toward the power bar 300 as shown in FIG. 5A with the connectors 404, 406 entering a gap 303 and engaging the rails within the power bar 300. These components are shaped to form an interference fit between the clips 412, 414 and rails; here the rails 302, 304 of power bar 300.

In order to achieve easy removal of the light bar 400, an L-shaped tool 500 is used. The tool 500 has two legs 502, 504 as shown in FIGS. 5F and 5G. The tool 500 is wider than the gap 303 of the bar 300 so it can be placed on top of the bar 300. The tool 500 is then positioned in order for the leg 502 to come in contact with a bottom surface 413 of the light bar 400. Pushing the tool 500 in direction A causes the tool 500 to lift the light bar 400 up and away from the power bar 300 as shown by arrow B.

The light bar 400 has been described as being attached to the power bar 300 of a modular lighting system shown in FIGS. 1-4H. However, the light bar 400 can be used in any other lighting system as well.

As can be seen for example in FIG. 5B, the spacing between the power bar 300 and the light bar 400 may be fairly small so that the hangers discussed above may be difficult to install therebetween. There are many other situations, in which it may be useful to have a hanger that requires less vertical space than the hangers described above. This is especially true for hangers used for supporting lighter pendants. Thus, the present invention provides a hanger with a low profile to make it easier to fit in smaller spaces.

Figure 6A:
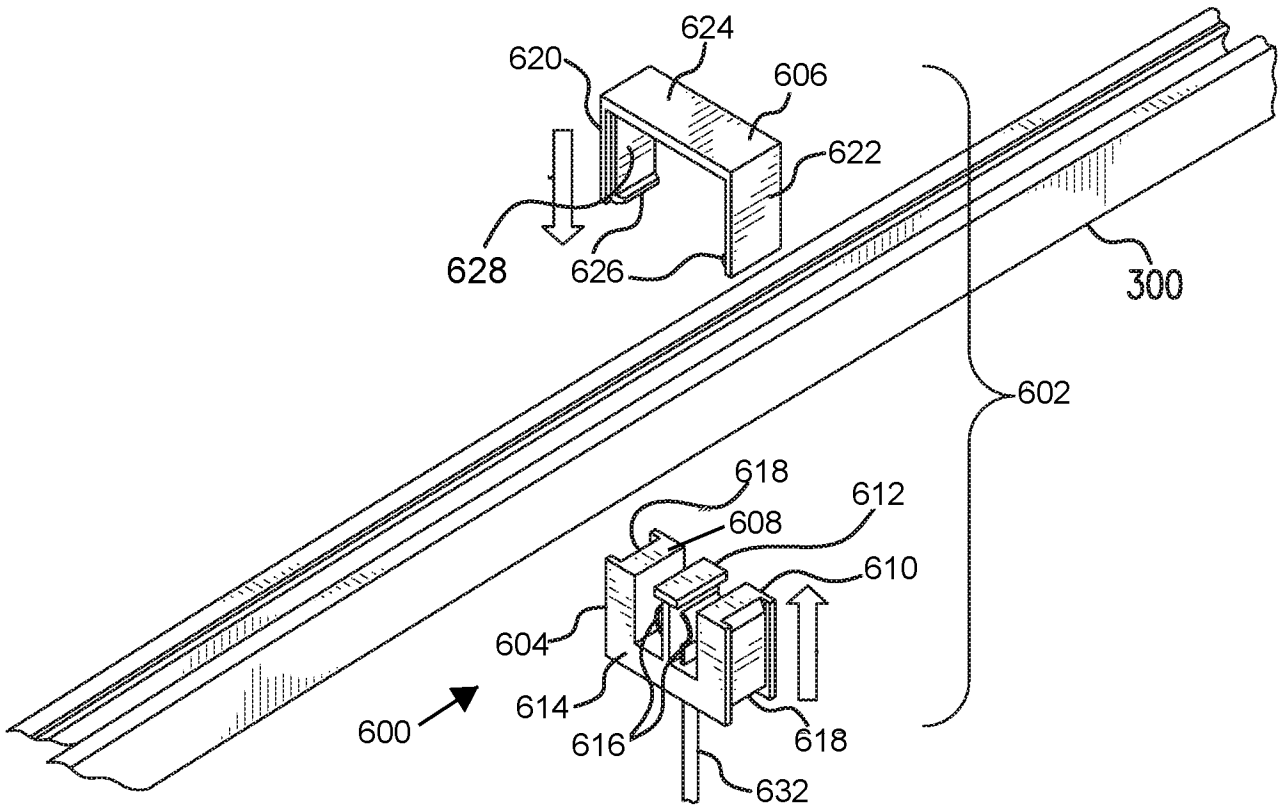
FIG. 6A is an assembly view of an embodiment of a hanger that can include a cord extending therefrom that is constructed in accordance with the present invention prior to attachment to a power bar.
Figure 6B:
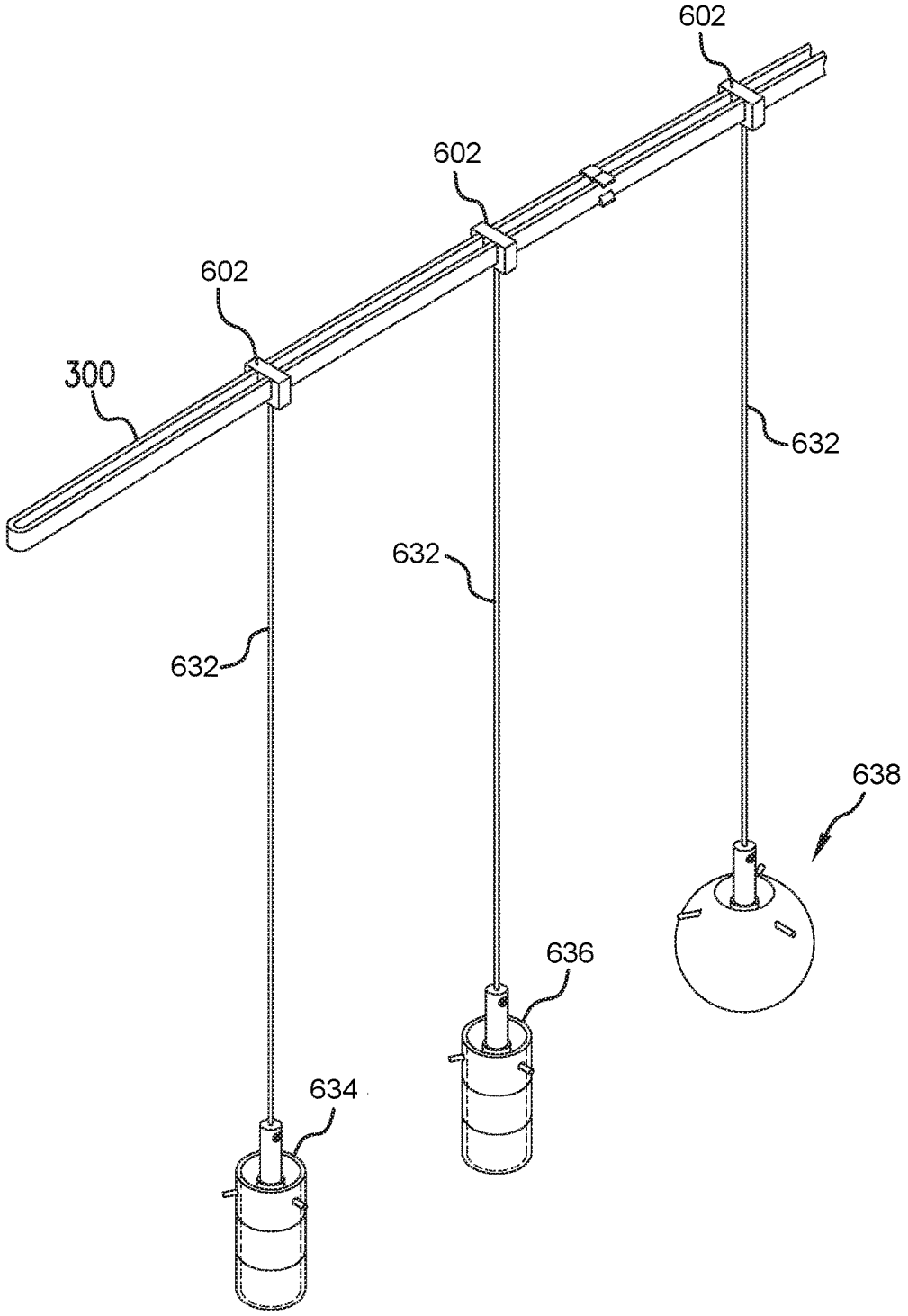
FIG. 6B is an isometric view of a power bar with several pendant supported by hangers, such as the hanger of FIG. 6A.

FIGS. 6A and 6B show one embodiment of such a hanger 600. As shown in FIG. 6A, the hanger 600 includes a housing 602 with a main body 604 and a cover 606. In FIG. 6A, the hanger 600 is attached for illustrative purposes to the power bar 300 depicted in FIGS. 3A-3K. The main body 604 has a W-Shape with two sidewalls, projections or side arms, 608, 610 and a center portion, or projection, 612 supported on a bottom or horizontal wall (e.g., base) 614. Adjacent to (and preferably supported by) the center portion 612 are two metallic clips 616 arranged and constructed to engage the respective conductive rails (such as the rails 302, 304 in FIG. 3E) within the power bar 300. The side arms 608, 610 and the horizontal wall 614 are formed on their outer surfaces with an external channel or indentation 618.

The cover 606 is U-shaped and has two legs, or side wings, 620, 622 and a center portion, or projection, 624. The side legs, which include a first leg 620 and a second leg 622 are formed with opposed ribs 626 on their internal surfaces 628. The cover 606 is shaped and sized so that it fits over the main body 604. When the cover 606 and the main body 604 are pushed toward each other as indicated by arrows R, the side legs 620, 622 and the ribs 626 slide into the indentations 618 thereby forming a unitary hanger 600 as shown in FIG. 6B. As the main body 602 and the cover 606 are snapped together, the clips 616 snap into the rails 302, 304 of the power bar 300 thereby making electrical contact therewith and at the same time forming an interference fit between the main body 604 and the power bar 300.

As shown in FIGS. 6A, 6B, the hanger 600 further includes an electric cord 632 with two internal wires (not shown). The internal wires are electrically coupled to the clips 616. As can be seen in FIG. 6B, the cord 632 is used to hang various pendants 634, 636, 638 on the power bar 300 with each of the pendants 634, 636, 638 being mechanically attached to the power bar 300 and receiving electrical power from the power bar 300 through the respective hanger 600.

Figure 6D:
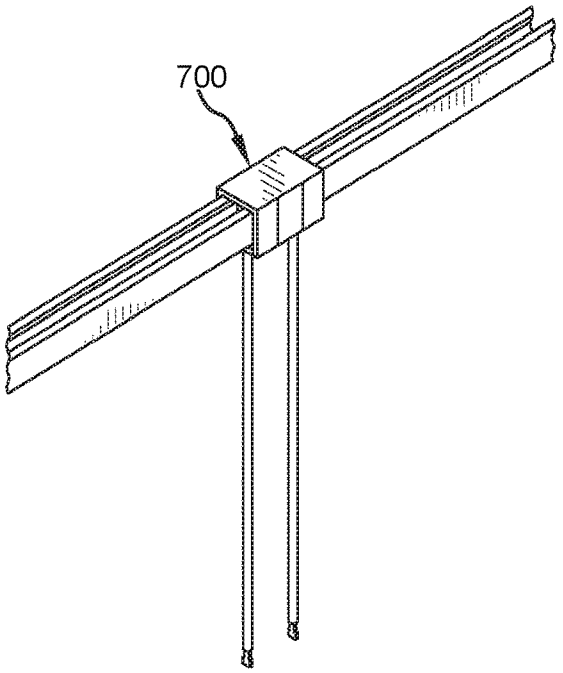
FIG. 6D is an isometric view of the hanger of FIG. 6C after attachment to the power bar.
Figure 6C:
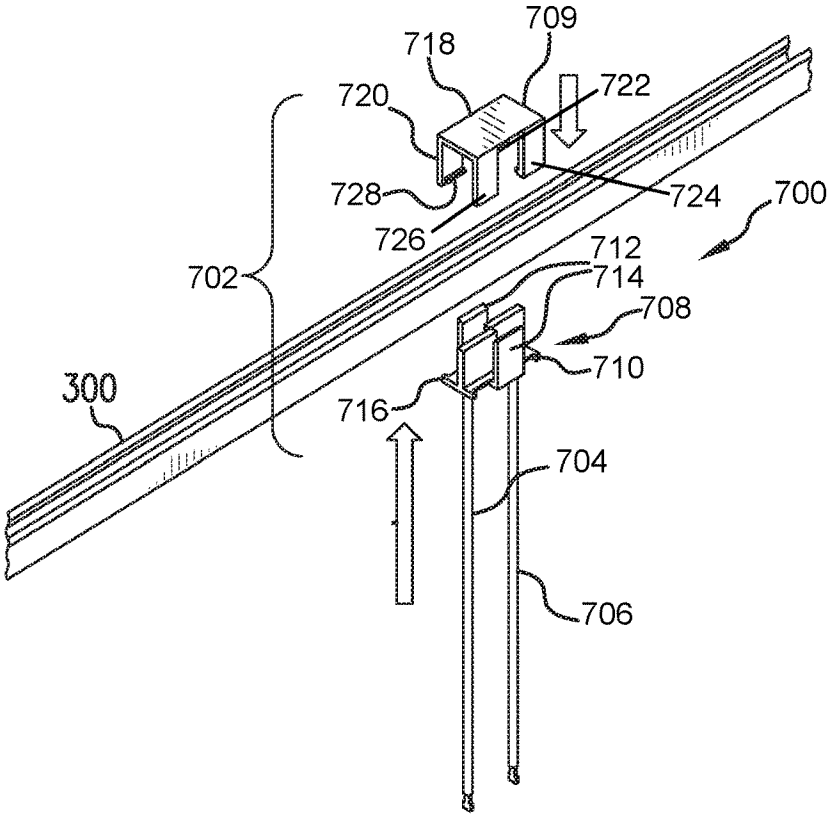
FIG. 6C is an isometric view of an embodiment of a hanger with two rods extending therefrom that is constructed in accordance with the present invention prior to attachment to a power bar.

FIGS. 6C and 6D show an embodiment of a hanger 700. The hanger 700 includes a housing 702 and two rods 704, 706. The housing 702 is formed of a main body 708 and a cover 709. The main body 708 includes a bottom wall, or base, 710, two vertical sidewalls, or projections, 712, 714 a central wall, or projection, 716. The sidewalls 712, 714 and the central wall 716 form two channels that receive the segments of the power bar 300. The central wall 716 holds two clips (not shown) similar to the clips 616 shown in FIG. 6A. The two rods 704, 706 depend on and extend downwardly from the bottom wall 710. Connectors (not shown) are used to electrically connect each of the rods 704, 706 to one of the clips attached to the central wall 716. The cover 709 includes a flat top wall, or base, 718 and four dependent vertical walls 720, 722, 724, 726. Each of the walls 720, 722, 724, 726 is formed with a respective rib 728 that extends inwardly. The cover 709 snaps over the main body 708 in an interference fit to form the housing 702.

The hanger 700 is used as follows. The main body 708 and the cover 709 are positioned as shown in FIG. 6C on the bottom and top of the power bar 300, respectively. The two members 708, 709 are snapped together in interference fit to form the housing 702 entrapping the power bar 300 therebetween. The lower end of each of the rods 704, 706 is attached to a respective pendant so that the hanger 700 provides both mechanical support and electric power to the respective pendant.

Figure 6F:
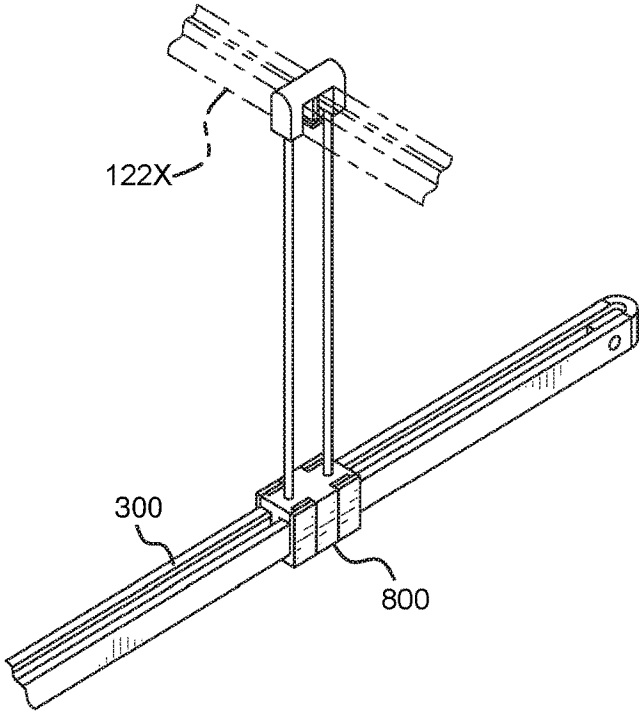
FIG. 6F is an isometric view of the hanger of FIG. 6E with the lower member being shown after attachment.
Figure 6E:
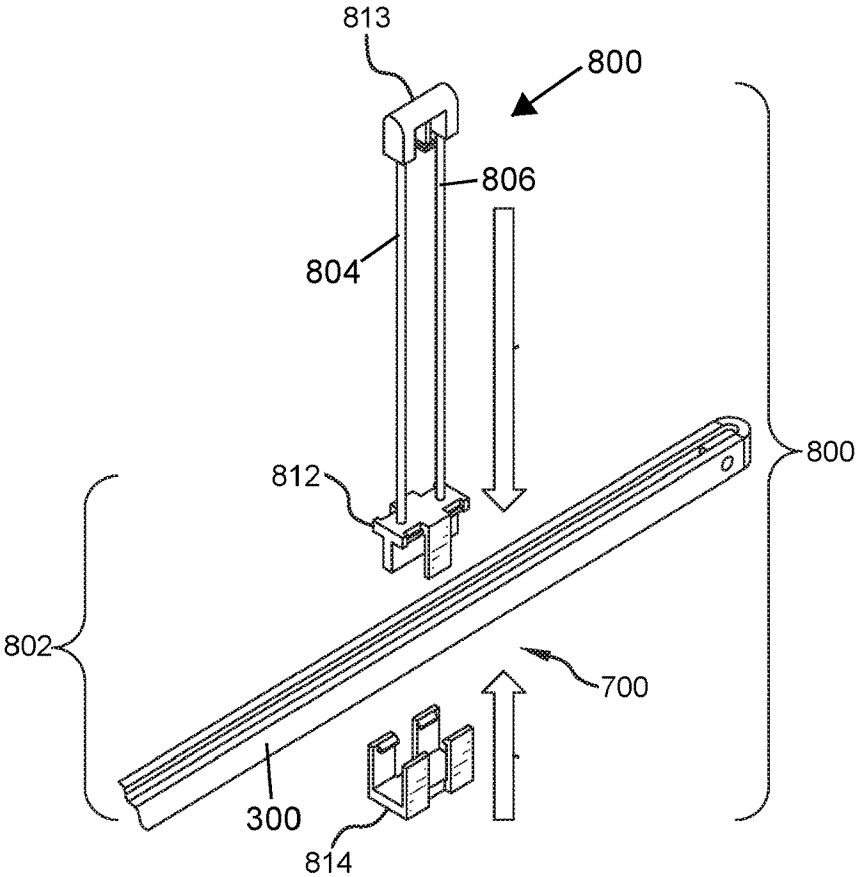
FIG. 6E is an isometric view of an embodiment of a hanger used for supporting one power bar from another power bar with the lower member being shown before attachment.

A hanger 800 in FIGS. 6E and 6F has a similar structure to the hanger 700 and includes a housing 802 that includes a main body 812 and a cover 814 with a structure similar to the main body 708 and the cover 709 illustrated in FIG. 6C, a housing 813, similar to the housing 113 having the structure shown in FIGS. 4B-4G, and two rods 804, 806. The upper ends of the rods 804, 806 engage the housing 813 while the lower ends engage or are connected to the main body 812 of the base 802. The main body 812 and the cover 814 are snapped together around a representative power bar 300 into the configuration shown in FIG. 6F. The housing 813 can be disposed around another power bar 122X. Thus, FIG. 6F shows the hanger 800 can be used to interconnect the two vertically spaced power bars 122 and 122X.

Numerous modifications may be made to this invention without departing from its scope as defined in the appended claims.

What is claimed is:

1. A hanger, which is part of a modular lighting system that includes a power bar and pendants where the power bar is comprised of two segments that are configured to deliver power to the pendants, said hanger comprising:

a main body including a bottom wall, a first sidewall extending from the bottom wall in a first direction, a second sidewall that is spaced from the first sidewall, extending from the bottom wall in the first direction and a projection extending from the bottom wall in the first direction, between the first sidewall and the second sidewall, the first sidewall, the second sidewall and the projection together defining two channels, each of said channels configured to receive one of the segments of the power bar;

clips extending from said bottom wall into each of said channels that are adaptable to form an interference fit with the segments of the power bar; and a conductive element attached to and extending away from said main body.

2. The hanger of claim 1, wherein said conductive element is connected to at least one of said clips.

3. The hanger of claim 1, wherein said main body has a generally W-shaped cross-section.

4. The hanger of claim 1, wherein said conductive element is a flexible cord.

5. The hanger of claim 1, wherein said conductive element is two parallel rods with each of the rods being connected to one of the respective clips.

6. The hanger of claim 1, further comprising a second main body configured to engage a second power bar, wherein said conductive element includes a first end connected to said main body and a second end that is attached to said a second main body.

7. A hanger, which is part of a modular lighting system that includes a power bar that is comprised of longitudinal segments, including a first segment and a second segment, and a pendant, which is supported by the power bar and to which the power bar delivers power, the hanger comprising:

a main body and a cover, said main body having a bottom wall, a projection extending from the bottom wall, a first channel and a second channel that is separated from the first channel by the projection, each of said first channel and said second channel being configured to receive the first segment and the second segment of the power bar, a first clip disposed in said first channel and a second clip disposed in said second channel, said first clip and said second being adaptable to be electrically connected to said first segment and said second segment, and said cover configured to form an interference fit with the main body and extend over said first channel and said second channel and secure the first segment and said second segment of the power bar within said first channel and said second channel.

8. The hanger of claim 7, further comprising a conductive member extending from said main body, and said first clip and said second clip being electrically connected to said conductive member.

9. The hanger of claim 7, wherein the first clip and the second clip are configured to form an interference fit with the longitudinal segments of the power bar.

10. The hanger of claim 8, wherein said conductive member is a cord.

11. The hanger of claim 8, wherein said conductive member are rods.

12. The hanger of claim 7, wherein the main body includes a first sidewall extending from the bottom wall in a first direction, a second sidewall that is spaced from the first sidewall, extending from the bottom wall in the first direction with the projection extending from the bottom wall in the first direction, between the first projection and the second projection.

13. The hanger of claim 12, wherein the first sidewall includes a first groove extending inwardly from an outer surface thereof the second sidewall includes a second groove extending inwardly from an outer surface thereof.

14. The hanger of claim 7, wherein the cover includes a center portion, a first leg extending from a first side of the center portion and a second leg extending from a second side of the center portion, the first leg including a first rib extending from a distal end thereof toward the second leg and the second leg including a second rib extending from a distal end thereof toward the first leg.

15. The hanger of claim 7, wherein said main body includes a first sidewall extending from a first side of the bottom wall and a second sidewall extending from a second side of the bottom wall.

16. The hanger of claim 15, wherein the bottom wall includes a first groove extending into the first side of thereof, a second groove that is spaced from the first groove by the first sidewall extending into the first side of thereof, a third groove extending into the second side of thereof and a fourth groove extending into the second side of thereof.

17. The hanger of claim 7, wherein the cover includes a center portion, a first leg extending from a first side of the center portion, a second leg, spaced from the first leg extending from the first side of the center portion, a third leg extending from a second side of the center portion and a fourth leg, spaced from the third leg extending from the second side of the center portion.

18. The hanger of claim 17, wherein the first leg includes a first rib extending from a distal end thereof toward one of the third leg and the fourth leg, the second leg includes a second rib extending from a distal end thereof toward one of the third leg and the fourth leg, the third leg includes a third rib extending from a distal end thereof toward one of the first leg and the second leg and the fourth leg includes a fourth rib extending from a distal end thereof toward one of the first leg and the second leg.

* * * * *